US011069197B2

(12) United States Patent
Peek et al.

(10) Patent No.: US 11,069,197 B2
(45) Date of Patent: Jul. 20, 2021

(54) METHOD AND SYSTEM OF DRAWING RANDOM NUMBERS VIA SENSORS FOR GAMING APPLICATIONS

(71) Applicant: WYE TURN LLC, Winchester, VA (US)

(72) Inventors: Catherine A Peek, Winchester, VA (US); Stephen M Gyurisin, Winchester, VA (US)

(73) Assignee: WYE TURN LLC, Winchester, VA (US)

( * ) Notice: Subject to any disclaimer, the term of this patent is extended or adjusted under 35 U.S.C. 154(b) by 0 days.

(21) Appl. No.: 16/812,153

(22) Filed: Mar. 6, 2020

(65) Prior Publication Data

US 2020/0286339 A1 Sep. 10, 2020

Related U.S. Application Data

(60) Provisional application No. 62/814,694, filed on Mar. 6, 2019.

(51) Int. Cl.
*G07F 17/32* (2006.01)
*A63F 3/06* (2006.01)

(52) U.S. Cl.
CPC ..... *G07F 17/3288* (2013.01); *A63F 3/06* (2013.01); *A63F 3/0605* (2013.01); *G07F 17/32* (2013.01); *G07F 17/329* (2013.01); *G07F 17/3267* (2013.01)

(58) Field of Classification Search
None
See application file for complete search history.

(56) References Cited

U.S. PATENT DOCUMENTS

2001/0044336 A1* 11/2001 Reiss ..... G07F 17/32 463/17
2006/0119034 A1* 6/2006 Bozeman ..... A63F 3/081 273/138.1
2008/0139316 A1* 6/2008 He ..... G07F 17/32 463/42

* cited by examiner

*Primary Examiner* — Jason T Yen
(74) *Attorney, Agent, or Firm* — Charter IP LLC; Matthew J. Lattig

(57) ABSTRACT

In a method and system for drawing random numbers based on outputs of a plurality of sensors in games involving wildlife which have one or more participating game players, a plurality sensors are arranged within a site area to cover a specific zone of interest (ZOI). Each sensor is assigned a randomly generated number value, and a sequenced drawing of the numbered sensors is called upon a triggering event resultant from a captured image of an animal in each of the numbered sensors' ZOI. The assigned value corresponding to its numbered sensor along with the image captured is stored, and the stored images are then analyzed to determine which of the stored images pass a criteria for bonus classification. For those game players associated with a numbered sensor whose captured image warrants a bonus classification, they are conveyed an award or bonus.

20 Claims, 12 Drawing Sheets

PRIOR ART

CONVENTIONAL ART

CONVENTIONAL ART

METHOD AND SYSTEM OF DRAWING RANDOM NUMBERS VIA SENSORS FOR GAMING APPLICATIONS

CROSS-REFERENCE TO RELATED APPLICATION

The present application claims priority under 35 U.S.C 119(e) to co-pending and commonly-assigned U.S. Provisional Patent Application Ser. No. 62/814,694 to Peek, et al., filed Mar. 6, 2019, the entire contents of which is hereby incorporated by reference herein.

BACKGROUND

Field

The example embodiments in general are directed to a method and system of drawing random numbers based on outputs of sensors for various gaming applications.

Related Art

In general, gaming is the running of specialized applications known as electronic games or video games on game consoles like X-BOX® and PLAYSTATION®, or on personal computers (PCs, tablets, smartphones, and the like, in which case the activity is known as online or mobile gaming). Gaming applications include non-gambling electronic/video games and gambling applications. In its most sophisticated form, a gaming interface can constitute a form of virtual reality. In the casino industry, mobile gambling applications include online and downloadable applications designed for a user or player to play games of chance or skill for money. As an example, these games may include one or more of slots, video poker, blackjack, roulette and baccarat, where a player desires to play on the move by using a remote device such as a tablet computer, smartphone, or a mobile phone with a wireless internet connection, as is known. The casino gaming industry offers a vast number of different gaming and mobile gambling applications.

A random number generator (RNG) is a device adapted to generate a sequence of numbers or symbols that cannot be predicted as accurately as by random chance. Random number generators can be true hardware random-number generators (HRNG), which generate genuinely random numbers, or pseudo-random number generators (PRNG) which generate numbers that look random, but are actually deterministic, and could actually be reproduced if the state of the PRNG is known. FIG. 1 is a block diagram of a prior art true hardware RNG and FIG. 2 a block diagram of a prior art pseudo RNG model. In FIG. 1, the entropy source consists of a physical system and a measuring equipment. Analog signals are further digitized. In practice, due to the imperfection of the physical devices, the resulting set of bits may contain some degree of autocorrelation. For this reason the initial sequence is usually subjected to additional post-processing and randomness extraction. The output of a perfect RNG is a random sequence of shorter length but with delta-correlation and uniform distribution.

FIG. 2 illustrates a prior art model for a PRNG. A PRNG generated random numbers on a computer that are indistinguishable from truly random numbers. As many applications do not have a source of truly random bits, these applications use PRNGs to generate these numbers. This is "pseudo random", because it is not possible to generate truly random numbers from a deterministic thing such as a computer.

In FIG. 2, the model collects unpredictable inputs. These inputs are collected in what is referred to as a "seed pool". After collecting sufficient seed data, the model moves to a stable state, from which it generates random outputs by performing various operations on the seed data.

RNGs have various applications in the video game industry at large and casino gaming industry. In video games, these random numbers are used to determine random events, like a chance at landing a critical hit or picking up a rare item. This inserts an element of randomness in the gameplay, making it unpredictable. RNGs are further applicable within statistical sampling algorithms, in computer simulation, cryptography, completely randomized design, and other areas where producing an unpredictable result is desirable.

Generally, in applications where unpredictability is paramount, such as in security applications, HRNGs are generally preferred over PRNG algorithms. Casinos often use PRNGs, which need no external numbers or data to produce an output, but merely require an algorithm and a seed number. The non-gambling video game and casino gaming industries both typically employ RNGs for virtual games; in the case of gambling, this is where there is no dealer online or offline. As an example, for slots, casinos assign a value to each of the symbols on a reel. In a 5-reel slot machine where each reel has 12 symbols, the RNG creates a value of 1-12 for each of the five reels. A player wins when the five "random" symbols make a winning combination.

Some state and national lotteries use RNGs on computers to generate the winning combination of digits; these systems today usually require substantially tight security. For example, in Oregon, the MEGABUCKS® random number generator sits at lottery headquarters in the state capital, under 24-hour video surveillance. However, the RNG is not connected to the state lottery's central computer system, and is constantly monitored for security issues. When it is time to draw the numbers, the central computer systems asks the RNG for the winning numbers.

Additionally, the numbers that are called in a game of bingo may also be drawn utilizing a variety of methods to randomly generate the ball call. With the expansion of computer technology in bingo, electronic RNGs are now commonplace in most jurisdictions. Accordingly, many modern games use RNGs and/or PRNGs. As both types of generators are algorithmic-based, gaming and/or gambling players often may feel that an algorithm is less enjoyable to play against.

With a general description of HRNGs and applicability thereof to gaming applications having been discussed above, the inventors have contemplated a way to employ HRNGs as part of a gaming (gambling or non-gambling) application involving wildlife. A majority of people would agree with a position that wildlife is important to all humans. Aside from its intrinsic value, wildlife provides critical benefits to support nature and people; accordingly, biodiversity conservation is becoming even more critically important. Unfortunately, wildlife is slowly but surely disappearing from the planet, which is further complicated by the lack of reliable and up-to-date information to understand and prevent this loss.

Motion-activated cameras or "camera traps" are often used around the globe to better understand how wildlife populations are changing. Biodiversity conservation depends on accurate, up-to-date information about wildlife population distributions. These camera traps are thus a critical tool for population surveys, due to being non-intrusive and relatively cost-effective. However, extracting useful information from camera trap images is a cumbersome process; a typical camera trap survey may produce millions of images that require slow, expensive manual review. Consequently, critical information is often lost due to resource limitations, and critical conservation questions may be answered too slowly to support decision-making.

Deep learning techniques are now being employed (e.g., artificial intelligence (AI) and/or machine learning (ML) models) to substantially increase accuracy and efficiency in image-based biodiversity surveys, enabling efficient automatic information extraction from camera trap images. The most common type of machine learning used for image classification is supervised learning, where input examples are provided along with corresponding output examples (for example, camera trap images with species labels), and algorithms are trained to translate inputs to the appropriate outputs.

Deep learning is a specific type of supervised learning, built around artificial neural networks. These neural networks are a class of machine learning models inspired by the structure of biological nervous systems. Each artificial neuron in a network takes in several inputs, computes a weighted sum of those inputs, passes the result through a non-linearity (known as a "sigmoid"), and transmits the result along as input to other neurons. Neurons are usually arranged in several layers: neurons of each layer receive input from the previous layer, process them, and pass their output to the next layer. A deep neural network is a neural network with three or more layers. Typically, the free parameters of the model that are trained are called the weights (or connections) between neurons, which determine the weight of each feature in the weighted sum.

The weights of a neural network (aka its parameters) determine how it translates its inputs into outputs; training a neural network means adjusting these parameters for every neuron so that the whole network produces the desired output for each input example. The accuracy of deep learning compared to other machine learning methods makes it applicable to a variety of complex problems.

However, the accuracy of these results depends on the amount, quality, and diversity of the data available to train these models, and these projects typically require millions of relevant, labeled training images. But many camera trap projects do not have a large set of labeled images, and hence cannot benefit from existing AI/ML techniques. Furthermore, even for those projects that do have labeled data from similar ecosystems, these projects have struggled to adopt deep learning methods because image classification models over-fit to specific image backgrounds (i.e., camera locations).

In the computer vision literature, image classification refers to assigning images into several pre-determined classes. More specifically, image classification algorithms typically assign a probability that an image belongs to each class. For example, species identification in camera trap images is an image classification problem in which the input is the camera trap image and the output is the probability of the presence of each species in the image. Image classification models can be easily trained with image-level labels, but they suffer from several limitations.

First, and typically, the most probable species are considered to be the label for the image; consequently, classification models cannot deal with images containing more than one species. Secondly, applying them to non-classification problems like counting results in worse performance than classification. Third, what the image classification models see during training are the images and their associated labels. The models have not been told what parts of the images they should focus on. Therefore, these models not only learn about patterns representing animals, but will also learn some information about backgrounds. This fact limits the models' transferability to new locations. Therefore, when applied to new datasets, accuracy is typically lower than what was achieved on the training data. In an example of this, a model trained on images from the United States could be less accurate at identifying the same species that images in a Canadian dataset.

Object detection algorithms attempt to not only classify images, but to locate instances of predefined object classes within images. Object detection models output coordinates of bounding boxes containing objects, plus a probability that each box belongs to each class. Object detection models thus naturally handle images with objects from multiple classes.

The ability of object detection models to handle images with multiple classes make them appealing for motion-activated camera or camera trap problems, where multiple species may occur in the same images. However, training object detection models requires bounding box and class labels for each animal in the training images.

Despite not explicitly being trained to do so, deep neural networks trained on image datasets often exhibit an interesting phenomenon: early layers learn to detect simple patterns like edges. Such patterns are not specific to a particular dataset or task, but they are general to different datasets and tasks.

Transfer learning is the application of knowledge gained from learning a task to a similar, but different, task. Transfer learning is highly beneficial where there is a limited number of labeled samples to learn a new task (for example, species classification in camera trap images when the new project has few labeled images), but where one has a large amount of labeled data for learning a different, relevant task (for example, general-purpose image classification). In this case, a neural network can first be trained on the large dataset and then fine-tuned on the target dataset.

Using transfer learning, the general features deep neural networks learn on within a large dataset can be reused to learn a smaller dataset more efficiently. In contrast to the supervised learning scenario, in which one first collects a large amount of labeled examples and then train a machine learning model, in an active learning scenario there is a large pool of unlabeled data and an oracle (e.g. a human) that can label the samples upon request.

Active learning iterates between training a machine learning model and asking the oracle for some labels, but it tries to minimize the number of such requests. The active learning algorithm must select the samples from the pool for the oracle to label so that the underlying machine learning model can quickly learn the requested task.

Active learning algorithms maintain an underlying machine learning model, such as a neural network, and try to improve that model by selecting training samples. Active learning algorithms typically start training the underlying model on a small, randomly-selected labeled set of data samples. After training the initial model, various criteria can be employed to select the most informative unlabeled samples to be passed to the oracle for labeling.

In light of the above, the inventors have identified a need to tie in conventional gaming applications which utilize RNGs, with the use of image and audio data collectors such as motion-activated cameras or camera/audio traps, so as to offer up a gaming or gambling method, system and application which adds a reality "seed" to an otherwise distrusted process by gambling and gaming players. Additionally, and as a by-product of offering an online or downloadable application to game players, may help increase awareness to people, and income to protect wildlife populations, their habitats and to assist owners of wildlife habitat areas so as to more effectively combat species loss.

SUMMARY

An example embodiment of the present invention is directed to a computer system adapted for drawing random numbers based on outputs of sensors in games involving wildlife which have one or more participating game players. The system may include one or more sensors arranged in various locations of a site area, each sensor covering a zone of interest (ZOI) in the site area, each sensor assigned a random number and triggered to capture an image upon an animal entering its ZOI so as to trigger the sensor. The system may include a random number generator (RNG) which, prior to commencement of game play, is configured to generate and assign values to each of the sensors in the site area, the one or more sensors represented as numbered sensors, a processing hardware set, and a computer-readable storage device medium. The processing hardware set is structured, connected and/or programmed to run program instructions stored on the computer-readable storage medium instructions and associated data, the program instructions including: a game application module programmed to allocate a respective numbered sensor to each of the participating one or more game players for game play, a drawing module programmed to call a sequenced drawing of the numbered sensors upon a triggering event resultant from a captured image of an animal in each of the numbered sensors' ZOI, a database for storing the assigned value corresponding to its numbered sensor along with the image captured upon the triggering event, a classification module programmed to analyze stored images to determine which of the stored images pass a criteria for bonus classification, and a gaming module programmed to convey an award to one or more of the game players associated with a numbered sensor whose captured image warrants a bonus classification.

Another example embodiment is directed to a computer-implemented method for drawing random numbers based on outputs of a plurality of sensors in games involving wildlife which have one or more participating game players. In the method, a plurality of sensors are arranged within a site area, each sensor covering a specific zone of interest (ZOI), with each sensor being assigned a randomly generated number value. A sequenced drawing of the numbered sensors is called upon a triggering event resultant from a captured image of an animal in each of the numbered sensors' ZOI, and the assigned value corresponding to its numbered sensor, along with the image captured, is stored. The stored images are then analyzed to determine which of the stored images pass a criteria for bonus classification, and for those game players associated with a numbered sensor whose captured image is determined to warrant a bonus classification, an award or bonus is conveyed.

Another example embodiment is directed to a gaming machine adapted to iterate games involving wildlife which have one or more participating game players. The gaming machine includes a plurality of motion-activated cameras arranged in various locations of a site area that is external to but in communication with the gaming machine, each motion-activated camera assigned a random number and triggered to capture an image upon an animal entering its view, and a random number generator (RNG) which, prior to commencement of game play, is configured to generate and assign values to each of the motion-activated cameras in the site area to represent a plurality of numbered cameras. The gaming machine additionally includes a game application module for allocating a respective numbered camera to each of the participating one or more game players for game play, a drawing module for calling a sequenced drawing of the numbered cameras upon a triggering event resultant from captured images of animals by the numbered cameras, and a database for storing the assigned value corresponding to its numbered camera along with the image captured upon the triggering event. The gaming machine further includes a classification module for analyzing stored images to determine which of the stored images pass a criteria for bonus classification, and a gaming module programmed to convey an award to one or more of the game players associated with a numbered camera whose captured image warrants a bonus classification.

BRIEF DESCRIPTION OF THE DRAWINGS

Example embodiments will become more fully understood from the detailed description given herein below and the accompanying drawings, wherein like elements are represented by like reference numerals, which are given by way of illustration only and thus are not limitative of the example embodiments herein.

DETAILED DESCRIPTION

Figure 1:
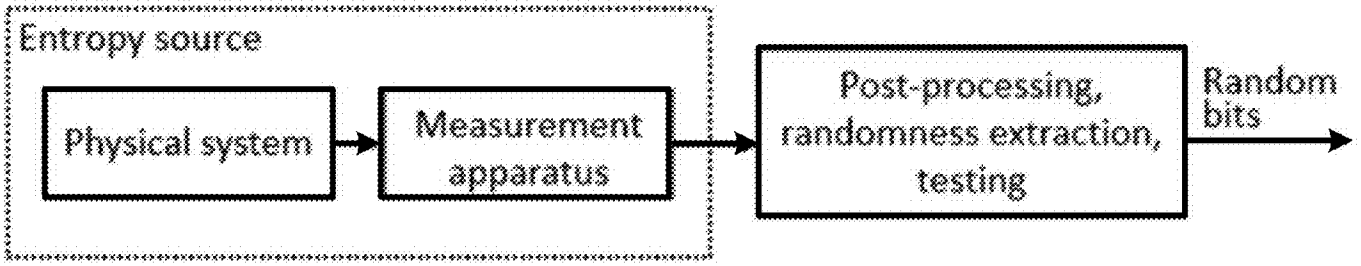
FIG. 1 PRIOR ART
FIG. 1 is a block diagram of a prior art true hardware RNG.

Accordingly, as to be described in more detail hereafter, the method and system hereafter described in accordance with the example embodiments may offer an alternative to algorithmic RNGs and PRNGs. Namely, the example method and system incorporates the drawing of random numbers based on outputs of sensors for various gaming applications, which are configured so as to create a link between real experiences that are captured as images, video, or audio, and the virtual aspect of the game.

The example method and system hereafter described may provide the opportunity to link elements of the real world to a system of gaming. The system and method may permit a connection of similarly identified elements to an existing state of being drawn from actual events and siting, or targets of the real world.

As to be hereafter described, the example method and system uses the leverage in the economics of gaming to achieve outcomes for habitats, select areas, and targets potentially on par with competing economic enterprises. This may provide a revenue source that has the capability to increase highest and best uses of undeveloped areas or sites with a force that counters other man-made forces competing for the same resources and sites.

In the following description, certain specific details are set forth in order to provide a thorough understanding of various example embodiments of the disclosure. However, one skilled in the art will understand that the disclosure may be practiced without these specific details. In other instances, well-known structures associated with manufacturing techniques have not been described in detail to avoid unnecessarily obscuring the descriptions of the example embodiments of the present disclosure.

As used herein, the term "sensor" may refer to a motion-activated camera or camera trap designed to capture an image, video, video with audio, and the like, upon detection of movement. More specifically, in addition to the above a sensor may be understood as any of a camera set on a timer, a video camera, a heat sensor, an infrared sensor, an infrared camera, a satellite image camera, a spectral data camera, any digital camera, a film camera, radar imagery, a sonar sensor, a traffic camera, a car-mounted camera, a security camera, a web-type camera, an audio sensor, an audio recording device, and the like. As used herein "sensory data" represents data captured by a sensor, which may be in the form of an image, video, video with audio, and the like, for example.

An "image" as referred to herein may be a still image, a single image, or a standalone image, or can be an image included in a series of images, e.g., a frame in a video sequence of video frames (with and without audio), or an image in a different type of sequence of images. For example, implementations described hereafter can be used with single images or with one or more images from one or more series or video sequences of images.

The overall quality of an image may refer to its general appeal to users with respect to a number of characteristics, including technical visual appearance (e.g., based on blurriness, exposure level, brightness, etc.), its depicted subjects (e.g., approved or generally desired content types depicted in the image), and/or possibly its social popularity (e.g., the number of users that like the image, the number of favorable ratings, comments, shares, and/or reviews of the image from users who have viewed the image, etc.).

As used herein, the phrase "gaming application" includes both online, mobile and/or downloadable gaming applications designed for a user or player to play games of chance or skill for money ("gambling applications"), and "social" electronic or video online, mobile and/or downloadable gaming applications for people having an interest of partaking in the social aspects of competitive games or games of chance or skill events, but who desire to add another element of involvement in the game without spending actual money ("non-gambling applications"). The gaming applications described herein may be configured to plug into or otherwise connect to a physical and existing gaming platform or gaming machine (which may be present or at one or more remote locations) via a universal interface layer.

Example gambling and/or non-gambling gaming applications may include online, mobile and/or downloadable applications with pre-determined targets, and recreational or sports-centric applications with random actions. Bingo and a lottery are mere examples of gaming applications requiring the outlay of money. Other gambling applications based on chance or selection to which the method and system may be applicable include online, mobile and/or downloadable casino-style gaming applications based around any of keno, slot machines, card games, random drawings, roulette type games, random drawings, wheel games, dice games, raffles, instant win lottery games, non-deterministic games, and the like.

Such gaming applications could, for example, be embodied by gambling or non-gambling match games and skill-based games using animals, fish, and/or birds, with or without a geographic component. In a particular embodiment described hereafter, the gaming application may interface with or otherwise require the use of motion-activated cameras or "camera traps" to capture images of animals, fish, and/or birds.

Other examples of non-gambling gaming applications envisioned by the example embodiments described hereafter include recreational or sports-centric social gaming applications that operate on a free-to-play business model, such as the suite of traditional sports games and e-sports social betting applications offered by European social casino game operator KAMAGAMES®, which have been added to their popular POKERIST™ app. In lieu of betting actual money, Pokerist players are able to use in-game virtual chips that they've already been rewarded, through either daily bonuses or from previous wins, to make wagers on real-life sporting events.

Although the example embodiments contemplate a computer system and computer implemented method for drawing random numbers based on outputs of a plurality of sensors in games involving wildlife which have one or more participating game players, the example embodiments are not so limited. In lieu of wildlife, the example embodiment can be directed to non-wildlife games and/or gaming applications such as sports gaming applications (gambling and or non-gambling instantiations.

As used herein, the terms "program" or "software" are employed in a generic sense to refer to any type of computer code or set of computer-executable instructions that can be employed to program a computer or other processor to implement various aspects of the present invention as discussed above. Additionally, it should be appreciated that one or more computer programs that when executed perform methods of the example embodiments need not reside on a single computer or processor, but may be distributed in a modular fashion amongst a number of different computers or processors to implement various aspects of the example embodiments.

Computer-executable instructions may be in many forms, such as program modules, executed by one or more computers or other devices. Generally, program modules include routines, programs, objects, components, data structures, etc., that perform particular tasks or implement particular abstract data types. Typically the functionality of the program modules may be combined or distributed as desired in various embodiments.

Additionally, a "computing device" as used hereafter encompasses any of a smart device, a firewall, a router, and a network such as a LAN/WAN. As used herein, a "smart device" is an electronic device, generally connected to other devices or networks via different wireless protocols such as Bluetooth, NFC, WiFi, 3G, 4G, etc., that can operate to some extent interactively and autonomously. Smart devices include but are not limited to smartphones, PCs, laptops, phablets and tablets, smartwatches, smart bands and smart key chains. A smart device can also refer to a ubiquitous computing device that exhibits some properties of ubiquitous computing including—although not necessarily—artificial intelligence. Smart devices can be designed to support a variety of form factors, a range of properties pertaining to ubiquitous computing and to be used in three primary system environments: physical world, human-centered environments, and distributed computing environments.

As used herein, the term "cloud" or phrase "cloud computing" means storing and accessing data and programs over the Internet instead of a computing device's hard drive. The cloud is a metaphor for the Internet.

Further, and as used herein, the term "server" is meant to include a computer system, including processing hardware and process space(s), and an associated storage system and database application (e.g., OODBMS or RDBMS) as is well known in the art. It should also be understood that "server system" and "server" are often used interchangeably herein. Similarly, any kind of database object described herein can be implemented as single databases, a distributed database, a collection of distributed databases, a database with redundant online or offline backups or other redundancies, etc., and might include a distributed database or storage network and associated processing intelligence.

The computer system(s), device(s), method(s), computer program product(s) and the like, as described in the following example embodiments, may be implemented in conjunction with a special purpose computer, a programmed microprocessor or microcontroller and peripheral integrated circuit element(s), an ASIC or other integrated circuit, a digital signal processor, a hard-wired electronic or logic circuit such as discrete element circuit, a programmable logic device or gate array such as PLD, PLA, FPGA, PAL, special purpose computer, any comparable means or the like. In general, any device(s) or means capable of implementing the methodology illustrated herein can be used to implement the various aspects of the example embodiments.

Computer program code for carrying out operations for aspects or embodiments of the present invention may be written in any combination of one or more programming languages, including a programming language such as JAVASCRIPT®, JAVA®, SQL™, PHP$^{7}$M, RUBY™, PYTHON®, JSON, HTML5™, OBJECTIVE-C®, SWIFT™, XCODE®, SMALLTALK™, C++ or the like, conventional procedural programming languages, such as the "C" programming language or similar programming languages, any other markup language, any other scripting language, such as VBScript, and many other programming languages as are well known may be used.

The program code may execute entirely on a user's computing device, partly on the user's computing device, as a stand-alone software package, partly on the user's computing device and partly on a remote computer or entirely on the remote computer or server. In the latter scenario, the remote computer may be connected to the user's computing device through any type of network, including a LAN or WAN, or the connection may be made to an external computer (for example, through the Internet using an Internet Service Provider).

Unless the context requires otherwise, throughout the specification and claims that follow, the word "comprise" and variations thereof, such as "comprises" and "comprising." axe to be construed in an open, inclusive sense, that is, as "including, but not limited to."

Reference throughout this specification to "one example embodiment" or "an embodiment" means that a particular feature, structure or characteristic described in connection with the embodiment is included in at least one embodiment. Thus, the appearances of the phrases "in one example embodiment" or "in an embodiment" in various places throughout this specification are not necessarily all referring to the same embodiment. Further, the particular features, structures or characteristics may be combined in any suitable manner in one or more example embodiments.

As used in this specification and the appended claims, the singular forms "a." "an," and "the" include plural referents unless the content clearly dictates otherwise. The term "or" is generally employed in its sense including "and/or" unless the content clearly dictates otherwise.

As used in the specification and appended claims, the terms "correspond." "corresponds." and "corresponding" are intended to describe a ratio of or a similarity between referenced objects. The use of "correspond" or one of its forms should not be construed to mean the exact shape or size. In the drawings, identical reference numbers identify similar elements or acts. The size and relative positions of elements in the drawings are not necessarily drawn to scale.

In general, the example embodiments hereafter introduce a method and system for drawing random numbers based on outputs of sensors for gaming applications having multiple players. For purposes of explanation only, the gaming applications implemented by the example method and system described hereafter are applicable to or envision a gambling or non-gambling match game and/or skill-based game built around movement of wildlife, namely using animals, fish, and/or birds, with or without a geographic component. The method and system may implement the example gaming application through an interface with or otherwise use sensors such as motion-activated cameras, camera traps, and the like to capture images of animals, fish, and/or birds.

In a commercial manifestation, a commercial platform based on the example computer system(s) and computer-implemented method described hereafter includes technology and digital offerings (e.g. website, mobile application, non-transitory, computer-readable information storage media, tools, etc.). In one example, the commercial platform includes a downloadable mobile app. The mobile app (which may be subscription-based) is designed to provide subscribers (game players) with access to gambling or non-gambling match games and/or skill-based games built around movement of wildlife, namely using animals, fish, and/or birds.

In one example, the commercial platform based on the example computer system(s) and computer-implemented method described hereafter may be directed to multiple sales channels, including but not limited to: (a) B2C direct via the mobile app downloaded from a digital distribution service such as the GOOGLE PLAY™, AMAZON® Appstore and/or App Store by APPLE®; (b) a B2B relationship whereby the game applications may be licensed and offered under a designated brand (such as by a casino or racetrack); and (c) a B2B relationship whereby the licensing entity rebrands the gaming applications for integration into their product suite (e.g., where UNREAL ENGINE® can be used to build or augment existing games, utilizing its system of tools and editors to organize your assets and manipulate them to create the gameplay for a game that could be added to an existing online gambling game).

Exemplary hardware that can be used for the example embodiments includes computers, handheld devices, telephones (e.g., cellular. Internet enabled, digital, analog, hybrids, and others), and other hardware known in the art. Some of these devices include processors (e.g., a single or multiple microprocessors), memory, nonvolatile storage, input devices, and output devices. Furthermore, alternative software implementations including, but not limited to, distributed processing or component/object distributed processing, parallel processing, or virtual machine processing can also be constructed to implement the methods described herein.

In yet another embodiment, the disclosed methods may be readily implemented in conjunction with software using object or object-oriented software development environments that provide portable source code that can be used on a variety of computer or workstation platforms. Alternatively, the disclosed system may be implemented partially or fully in hardware using standard logic circuits or VLSI design. Whether software or hardware is used to implement the systems in accordance with this invention is dependent on the speed and/or efficiency requirements of the system, the particular function, and the particular software or hardware systems or microprocessor or microcomputer systems being utilized.

Any combination of computer-readable media may be utilized. Computer-readable media may be a computer-readable signal medium or a computer-readable storage medium. A computer-readable storage medium may be, for example, but not limited to, an electronic, magnetic, optical, electromagnetic, infrared, or semiconductor system, apparatus or device, or any suitable combination of the foregoing. A non-exhaustive list of specific examples for a computer-readable storage medium would include at least the following: an electrical connection having one or more wires, a portable computer diskette, a hard disk, a random access memory (RAM), a read-only memory (ROM), an erasable programmable read-only memory (EPROM or Flash memory), an optical fiber, a portable compact disc read-only memory (CD-ROM), an optical storage device, a magnetic storage device, or any suitable combination of the foregoing.

Figure 3:
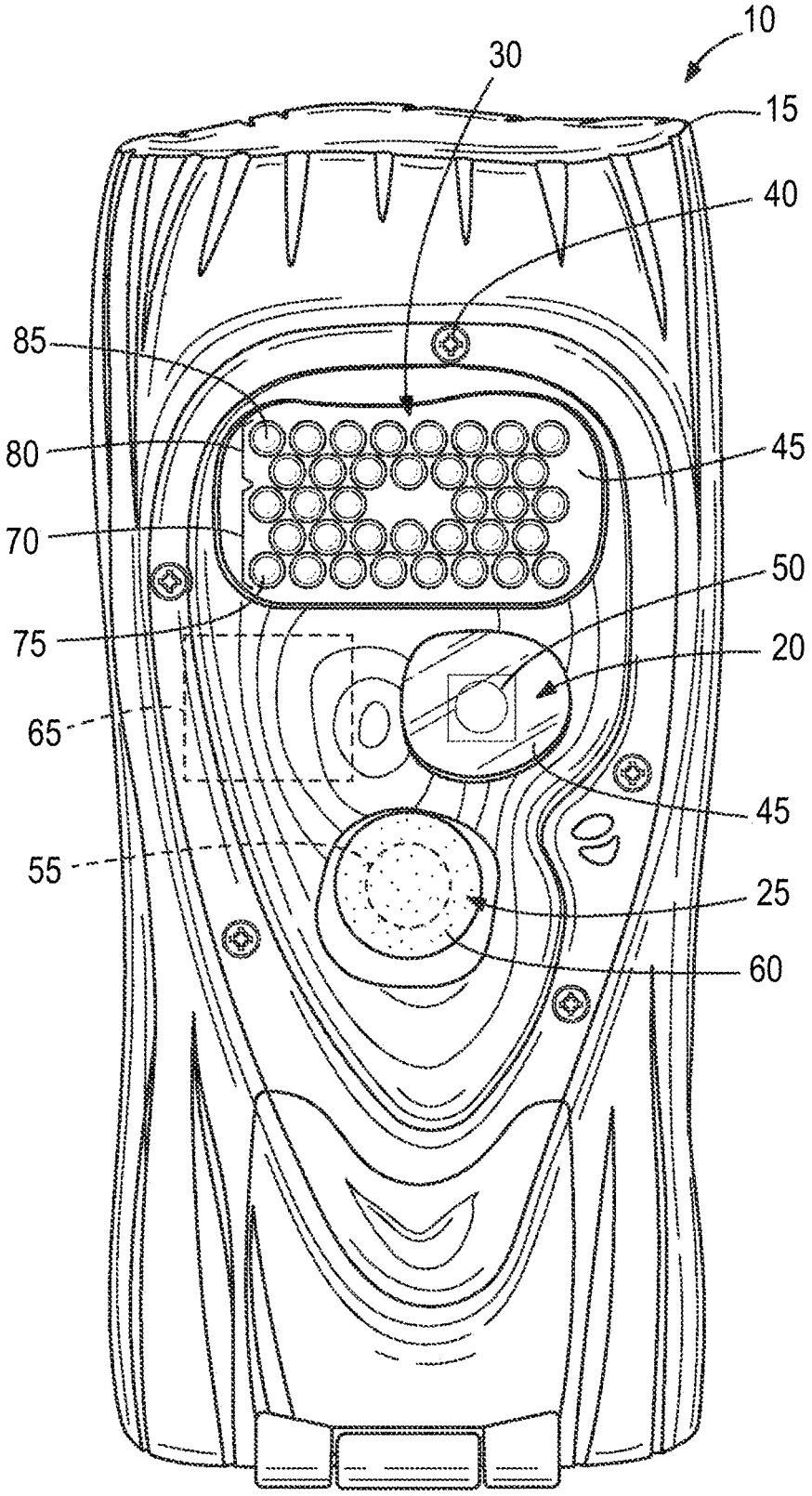
FIG. 3 is a front plan view of a conventional wildlife trail camera assembly as an example sensor according to the example embodiments.
Figure 4:
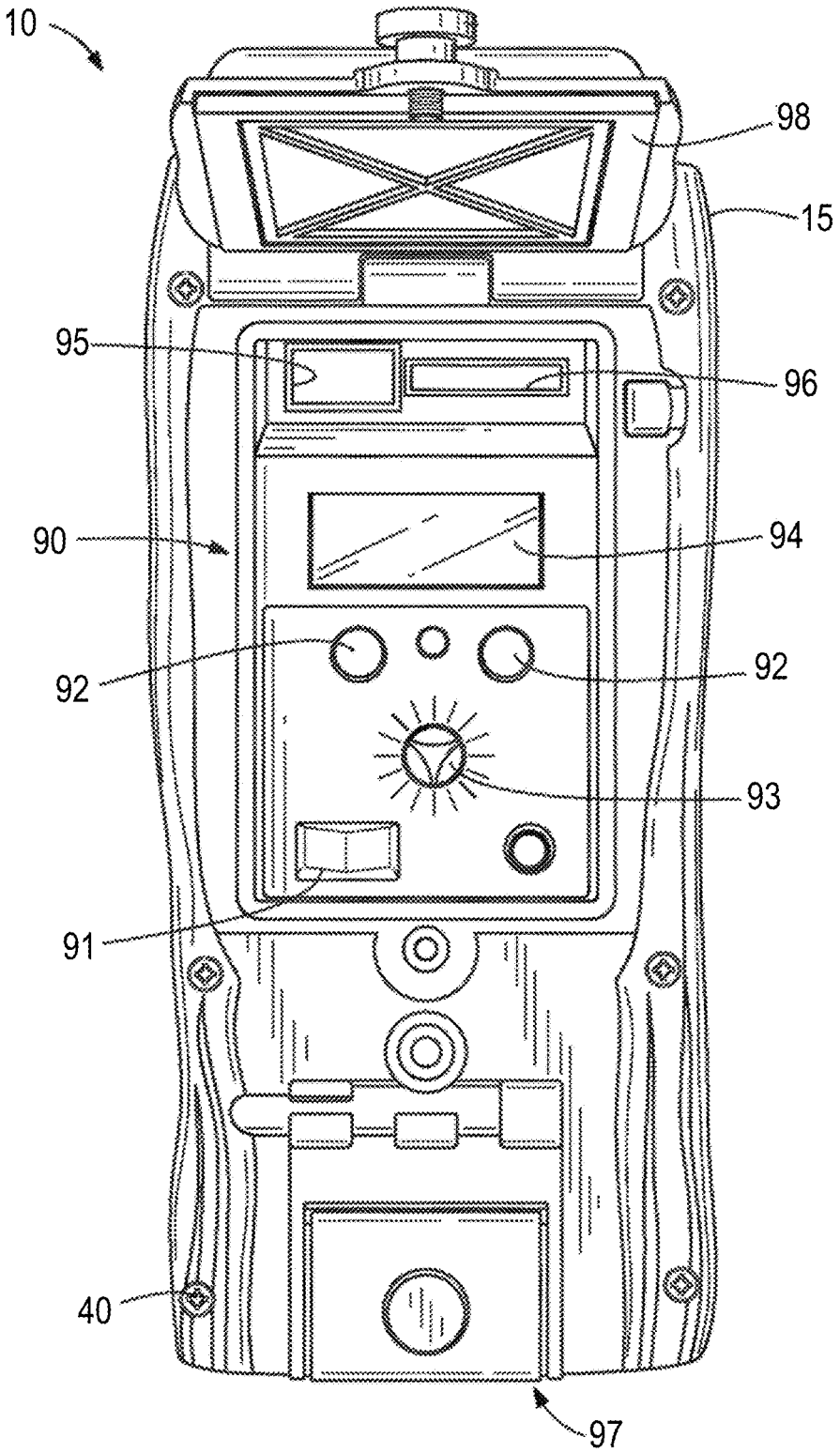
FIG. 4 is a rear plan view of the camera assembly of FIG. 1.

The computer system includes one or more sensors arranged in various locations of a site area, each sensor covering a specific zone in the site area or "zone of interest (ZOI)". As an example of one kind of sensor, FIGS. 3 and 4 are respective front and rear plan views of a conventional wildlife trail camera assembly which may signify a sensor according to the example embodiments. Camera assembly 10 may be attached to a mounting structure (e.g., a tree, a post, etc.) and has a housing 15 supporting camera 20, a detector 25, and an illumination device 30 (e.g., flash) for taking pictures, images, audio and/or video (collectively "media") of subjects (e.g., wildlife/animals). Camera assembly 10 exemplifies the previously described motion-activated camera or camera trap embodying the sensors according to the example embodiments.

With reference to FIG. 3, housing 15 may include transparent windows 45 to protect the camera 20, illumination device 30, and detector 25 from the environment while also providing exposure (i.e., a clear line of sight) for the camera 20, illumination device 30, and detector 25. Camera 20 includes an image-capturing device 50 (e.g., a digital receiver) having a still image mode for obtaining still images of subjects, and a video image mode for obtaining video images of subjects. In some constructions, the camera 20 may include a hybrid or multi-image mode for obtaining still and video images of subjects (e.g., consecutively or at timed intervals). Each of the still, video, and hybrid image modes define an operating parameter of the camera 20 that impacts how the subject is illuminated.

The detector 25 includes a passive infrared ("PIR") sensor 55 and a lens 60 (e.g., a Fresnel lens). The sensor 55 detects a subject (animal) and outputs a signal to a processor or control unit 65 in response to that detection. The lens 60 defines a field of view of the detector 25 and focuses infrared radiation generated or reflected by a warm subject (animal) in the field of view onto the PIR sensor 55. Detector 25 may have a wide field of view (e.g., approximately 45-180°) to encompass a substantial area of the ZOI in front of the camera assembly 10, a narrow field of view (e.g., approximately 15-45°), or a combination thereof.

Illumination device 30 is configured to illuminate a subject in at least two different peak wavelengths of light as the camera 20 captures an animal an image. Illumination device 30 includes a first light source 70 with light elements 75 (e.g., LEDs, strobe, etc.) and a second light source 80 with light elements 85 (e.g., LEDs, strobe, etc.) disposed above the first light source 70, although this relative orientation can be reversed. Each illustrated light source 70, 80 includes multiple light elements 75, 85.

In some constructions, the light sources 70, 80 can be arranged side-by-side or in other patterns. Furthermore, the first and second light sources 70, 80 can be arranged so that individual light elements 75, 85 are interspersed among each other randomly or in a pattern. For example, one LED 75 of the first light source 70 can be positioned next to one or more LEDs 85 of the second light source 80, and vice versa.

Generally, light that is visible to a subject has a wavelength of approximately 770 nm (i.e., the visible wavelength). The first light source 70 is configured to emit infrared light at a first peak wavelength, and the second light source 80 configured to emit infrared light at a second peak wavelength. As one example, the first peak wavelength can be between approximately 740 nanometers (nm) and 900 nm (the lower end visible to the animal), and the second peak wavelength, being longer than the first peak wavelength, can be at or above 875 nm (invisible to the animal).

Housing 15 further supports a user interface 90 for controlling the camera assembly 10 and determining the state of the camera assembly 10. As shown in FIG. 4, the user interface 90 is disposed along the rear side and has a selector switch 91, button switches 92, a rotary dial 93, and a display 94. The selector switch 91 is a three-position toggle that controls the camera mode (e.g., still image mode, video image mode, and hybrid image mode). The button switches 92 and the rotary dial 93 can be manipulated by the user to control the camera assembly 10, and to obtain information regarding the state of the camera assembly 10 (e.g., adjusting the programmable settings of the camera assembly 10 such as the time interval between images, the time of day, etc.). The settings and the information associated with the camera assembly 10 can be viewed on the display 94.

Camera assembly 10 further includes electrical and/or electronic connections (e.g., USB port 95, media storage port 96, etc.) to facilitate storage and retrieval of media from the camera assembly 10. Batteries 97 power components of the camera assembly 10 and facilitate downloading media stored in the camera 20. A cover 98 is pivotally coupled to the housing 15 to enclose the user interface 90 and electronic connections to protect from debris, water, sunlight, rain, etc., when not in use.

Additionally, a control unit 65 may be disposed in housing 15, in communication with the camera 20, detector 25, illumination device 30, and user interface 90 (as is known) to control functions of the camera assembly 10. The detector 25 triggers the camera 20 to take a picture or start a video, or both consecutively, when the PIR sensor 55 detects and responds to infrared light (or a change in infrared light due for example to animal movement across the monitored ZOI) within the field of view of the detector 25. Namely, the control unit 65 receives information from the PIR sensor 55 and is programmed to actuate camera 20 when the subject is within the field of view, hence "motion-activated".

As to be described in detail hereafter, each sensor is assigned a random number, with a given sensor triggered to capture an image, as on example, upon detection of movement, e.g., an animal entering the ZOI covered by the given sensor. Zone of Interest (ZOI) locations for camera 202 installation may be selected from a group comprising one or more of (a) land sites or underground sites (examples being temperate deciduous forests, terrestrial ecosystems, savannas, rainforests, prairies, grasslands, taigas, tundra, and deserts: (b) locations in the air or space; (c) locations on the water or underwater (examples being wetlands, salt marshes, estuaries, freshwater ecosystems, marine ecosystems, swamps, and aquatic ecosystems); and/or (d) sites in urban areas or non-urban areas, indoors or outside.

The triggering of a sensor (by animal movement for example) causes a random drawing of the one or more of the sensors, whereby, for each sensor, its assigned random number together with its captured image are input to a database to be stored. Each game player participating in a gaming application is assigned an image with random number, either in return for a money wager, or in a social setting as described above where no money is being wagered (perhaps in return for betting virtual chips to mirror the feeling of betting actual money).

Each of the captured images. (or video with and without audio) stored in the database is then verified and classified, so as to determine whether it passes a bonus evaluation criteria for acceptance. A bonus may be awarded to any game player whose verified and classified image passes the bonus evaluation, along with the winning image, which may be sent to a gaming device being played by the game player (or remotely to a smart electronic device of the game player) together with the bonus (which may be monetary (cash or credit), which may alternatively be non-monetary (such as virtual chips/virtual money)).

Figure 5:
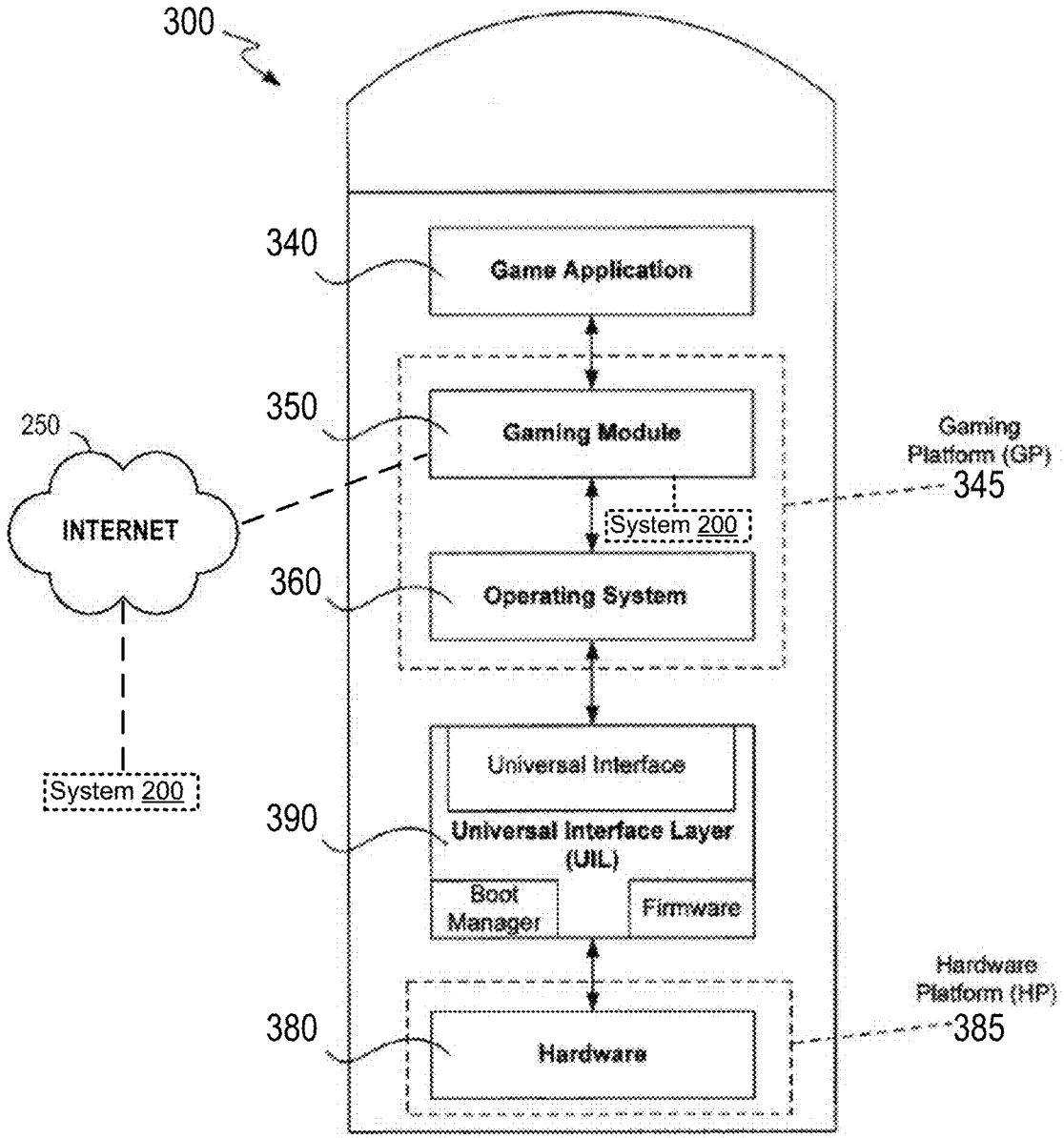
FIG. 5 is an exemplary software and hardware architecture for a gaming machine to which the example method and system may be adapted to interface with or otherwise be run by for various gaming applications.
Figure 6:
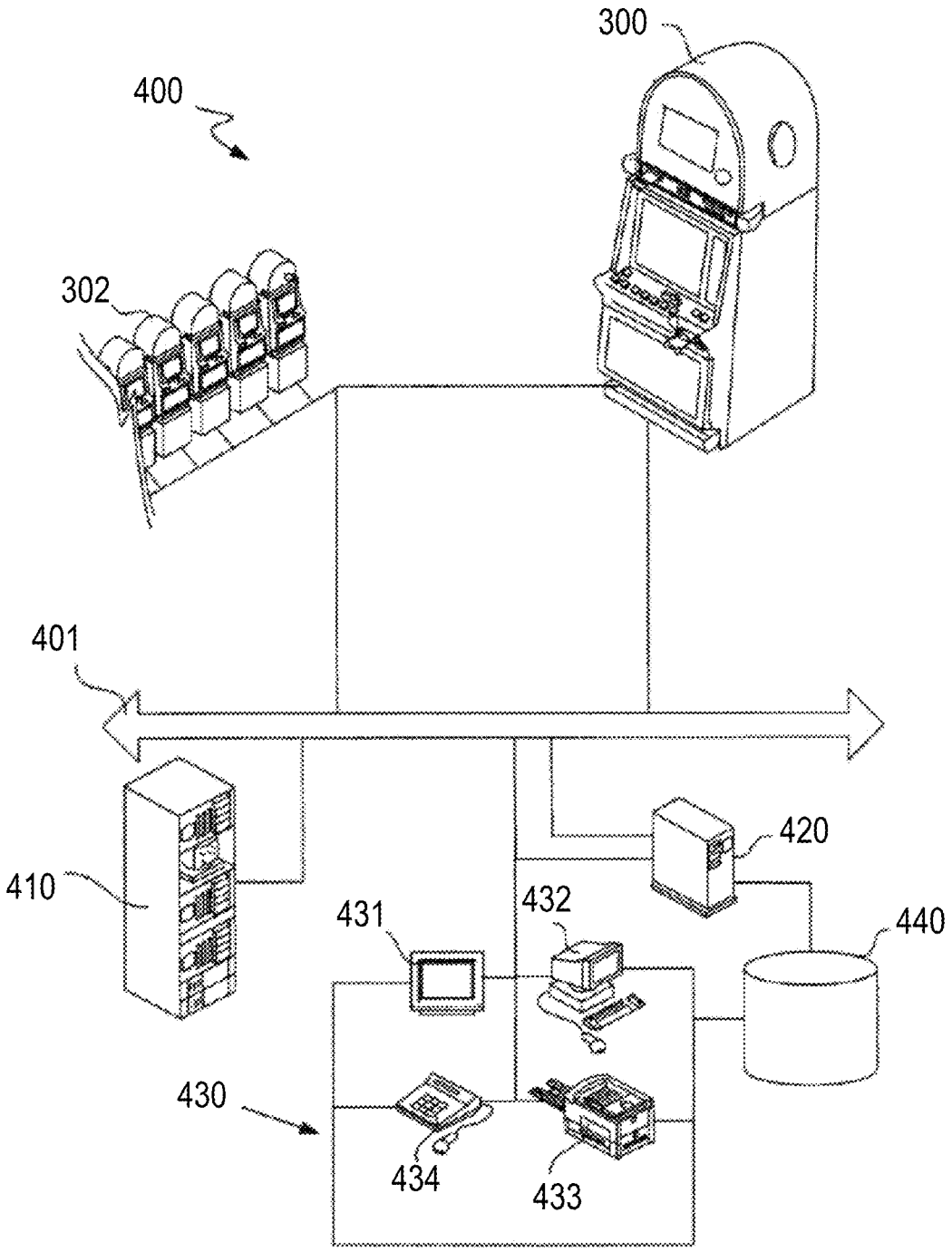
FIG. 6 is an exemplary block diagram of a network infrastructure for providing a gaming system with one or more gaming machines according to the example embodiments.

FIG. 5 is an exemplary software and hardware architecture for a gaming machine to which the example method and system may be adapted to interface with or otherwise be run by for various gaming applications. FIG. 5 and the follow-on FIG. 6 are based on the architecture described in U.S. Pat. No. 8,549,276 to Chen, et al., entitled "Universal Operating System to Hardware Platform Interface for Gaming Machines", the relevant portions of FIGS. 4 and 9 in the '276 patent being incorporated by reference herein. For this example gaming machine 300, the software and hardware architecture may be broken down into various categories, including a Game Application 340, a Gaming Module 350, an Operating System 360, a Universal Interface Layer ("UIL") 390 and Hardware 380. The Game Application 340 contains the specific game software application for the actual game or set of games that are played on gaming machine 300. Example game applications include the specific software to run specific game titles, such as, for example, a "Wheel of Fortune" game, a "Star Wars" game, a "Drew Carey" game, a "Deuces Wild" video poker game, or a "Lucky 7*s*" slots game, as well as wildlife-based games contemplated by the example embodiments, among others.

The Gaming Module 350 and Operating System 360 generally combine to form a Gaming Platform ("GP") 345. In addition, the Hardware 380 generally forms a Hardware Platform ("HP") 385 for gaming machine 300. The Gaming Module 350 generally includes many or all of the software modules and routines outside of the operating system 360 that are needed to run a given game application 340 with a given operating system and given sets of firmware and hardware 380 on a gaming machine. In this respect, the various modules and routines that are exemplified by the hereafter described example method and system 200 of drawing random numbers based on outputs of sensors for gaming applications accessible by one or more game players may be operatively connected to or otherwise contained within as part of the Gaming Module 350. Alternatively, system 200 implementing the various routines of the example method may be remote from gaming machine 300 and may interact with the Gaming Module 350 via the internet 250.

A Universal Interface Layer 390 may be implemented within the software and hardware architecture of gaming machine 300 to provide various APIs, some forming a Universal Interface, and other software modules in a software layer between the gaming platform and the hardware platform such that interchangeability of platforms can be accomplished. In some embodiments, a specific Gaming Platform 345 used in a given gaming machine 300 may be completely independent of the specific Hardware Platform 385 used, such that an entire Gaming Platform 345 can be designed, written, and/or swapped out of an existing gaming machine 300 without needing to swap out or substantially alter a given Hardware Platform 385.

Among its various components, the UIL 390 can include data tables with platform-related information, as well as pre-boot and run-time services available to a pre-boot environment Boot Manager and the operating system 360. This UIL 390 enables both the gaming platform 345 and the specific firmware to communicate information to support the operating system 360 boot or initialization process.

Operating System 360 runs the gaming machine 300, and can be QNX, Windows CE, another commercially available operating system, or any custom designed operating system. In addition, the UIL 390 can be designed to contain some or all of the Firmware for gaming machine 300, as well as a universal interface made up of various OS to UIL 390 APIs to facilitate communications between the Operating System 360 and other parts of the UIL 390.

FIG. 6 is an exemplary block diagram of a network infrastructure for providing a gaming system with one or more gaming machines according to the example embodiments. Gaming system 400 may have one or more gaming machines 300, various communication items, and a number of host-side components and devices adapted for use within a gaming environment. As shown, one or more specialized gaming machines 300 adapted for use in gaming system 400 can be in a plurality of locations, such as in banks on a casino floor or standing alone at a smaller non-gaming establishment (on example being a World Wildlife Foundation (WWF) location), as desired. Of course, other gaming devices such as non-specialized gaming machines 302 may also be used in gaming system 400, as well as other similar gaming and/or non-gaming devices not described in added detail herein.

A common bus 401 can connect one or more gaming machines or devices to a number of networked devices on the gaming system 400, such as, for example, a general-purpose server 410, one or more special-purpose servers 420, a sub-network of peripheral devices 430, and/or a database 440. Such a general-purpose server 410 may be already present within an establishment for one or more other purposes in lieu of or in addition to monitoring or administering some functionality of one or more specialized gaming machines, such as, for example, providing visual image, video, audio, player tracking details or other data to such gaming machines. Functions for such a general-purpose server 410 can include general and game specific accounting functions, payroll functions, general Internet and e-mail capabilities, switchboard communications, and reservations and other hotel and restaurant operations, as well as other assorted general establishment record keeping and operations.

In some cases, specific gaming related functions such as player tracking, downloadable gaming, remote game administration, visual image, video, audio or other data transmission, or other types of functions may also be associated with or performed by such a general-purpose server 410. For example, such a server 410 may contain various programs related to player tracking operations, player account administration, remote game play administration, remote game player verification, remote gaming administration, downloadable gaming administration, and/or visual image, video, or audio data storage, transfer and distribution, and may also be linked to one or more gaming machines 300/302 adapted for the transfer of remote funds for game play within an establishment, in some cases forming a network that includes all or substantially all of the specially adapted gaming devices or machines within the establishment. Communications can then be exchanged from each adapted gaming machine to one or more related programs or modules on the general-purpose server 410.

Gaming system 400 may additionally contain one or more special-purpose servers 420 for various functions relating to the provision of gaming machine administration and operation. Such special-purpose servers 420 can include, for example, a player verification server, a general game server, a downloadable games server, a specialized accounting server, and/or a visual image or video distribution server, among others. Additional special-purpose servers 420 are desirable, for example, to lessen the burden on an existing general-purpose server 410 or to isolate or wall off some or all gaming machine administration and operations data and functions from the general-purpose server 410 and thereby limit the possible modes of access to such operations and information.

Alternatively, gaming system 400 can be isolated from any other network at the establishment, such that a general-purpose server 410 is essentially impractical and unnecessary. Under either embodiment of an isolated or shared network, one or more of the special-purpose servers 420 are preferably connected to sub-network 430. Peripheral devices in this sub-network 430 may include, for example, one or more video displays 431, one or more user terminals or cashier stations 432, one or more printers 433, and one or more other digital input devices 434, such as a card reader or other security identifier, among others. Similarly, under either embodiment of an isolated or shared network, at least the specialized server 420 or another similar component within a general-purpose server 310 also preferably includes a connection to a database or other suitable storage medium 440.

Database 440 may be adapted to store many or all files containing pertinent data or information for gaming machines 300/302, system equipment, casino personnel, and/or players registered within a gaming system, among other potential items. Files, data and other information on database 440 can be stored for backup purposes, and are accessible to one or more system components, such as at a specialized gaming machine 300, a general-purpose server 410, and/or a special purpose server 420, as desired. Database 440 is also accessible by one or more of the peripheral devices on sub-network 430, such that information or data recorded on the database 440 may be readily retrieved and reviewed at one or more of the peripheral devices, as desired. Although shown as directly connected to common bus 401, a direct connection can be omitted and that only a direct connection to a server or other similar device be present in the event that heightened security with respect to data files is desired.

Although gaming system 400 is contemplated for use in a casino or gaming establishment implementing specialized gaming devices such as gaming machines 300, many items in this system 400 can be taken or adopted from another, existing gaming system. For example, gaming system 400 could represent an existing player tracking system to which specialized gaming machines 300 are added. Also, new functionality via software, hardware or otherwise can be provided to an existing database, specialized server and/or general server.

Figure 7:
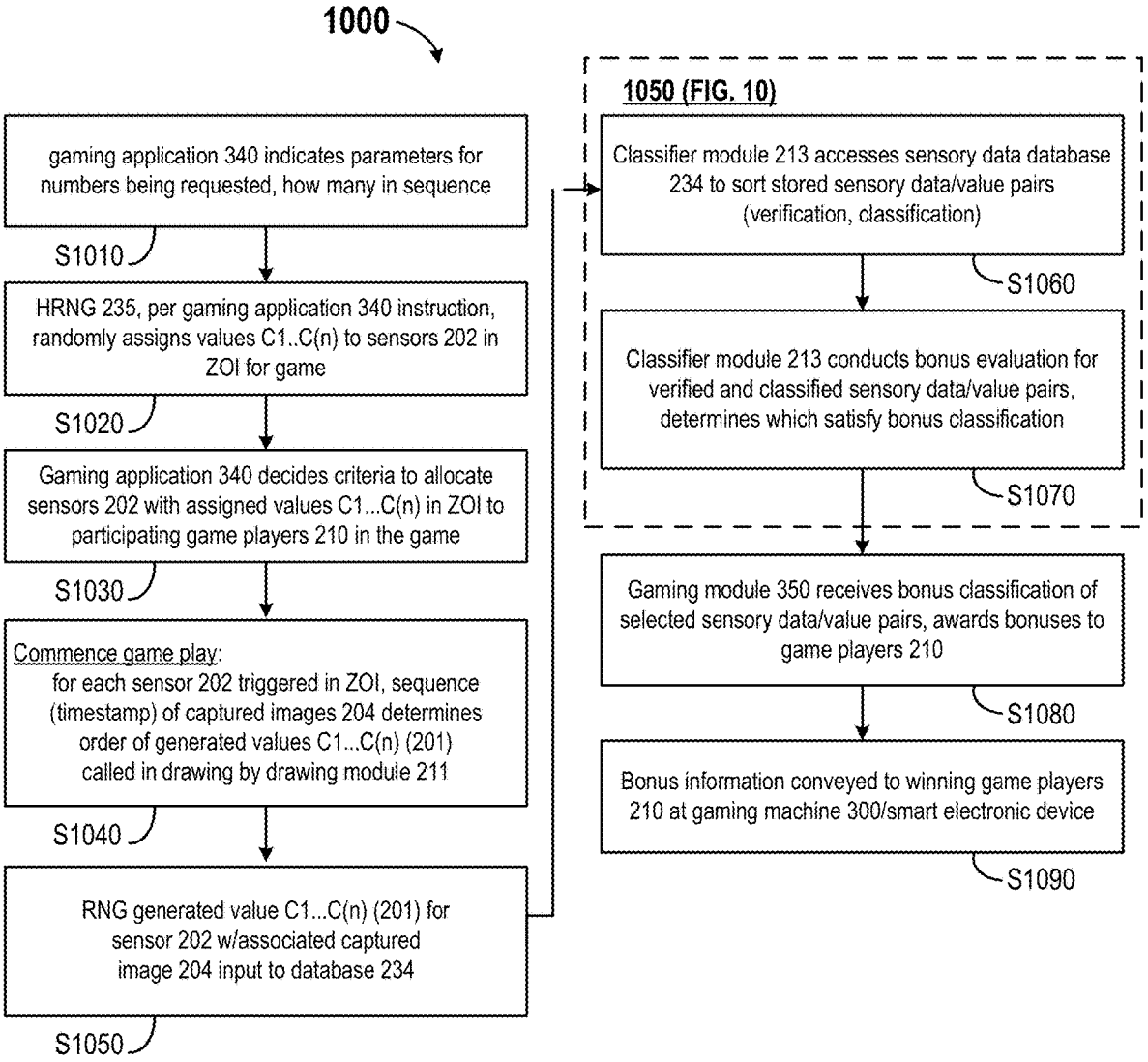
FIG. 7 is a flowchart to describe a method of drawing random numbers based on outputs of sensors for gaming applications having multiple players, according to the example embodiments
Figure 8:
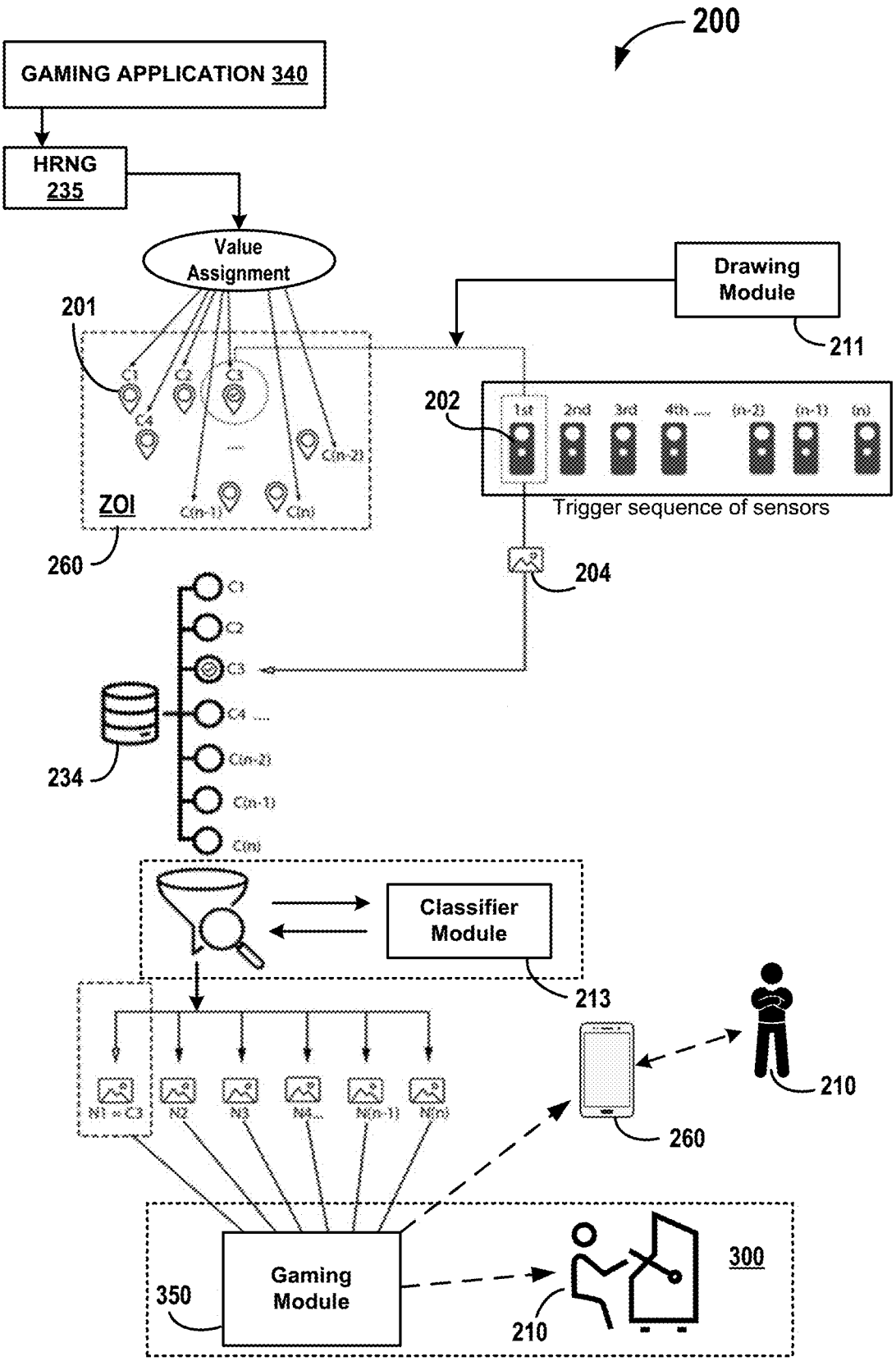
FIG. 8 is a pictorial flow diagram of the method and system for drawing random numbers based on outputs of sensors for various gaming applications, according to the example embodiments.

FIG. 7 is a flowchart to describe a method of drawing random numbers based on outputs of sensors for gaming applications having one or multiple game players, according to the example embodiments, and FIG. 8 is a pictorial flow diagram of the method and system for drawing random numbers based on outputs of sensors for various gaming applications.

Figure 9:
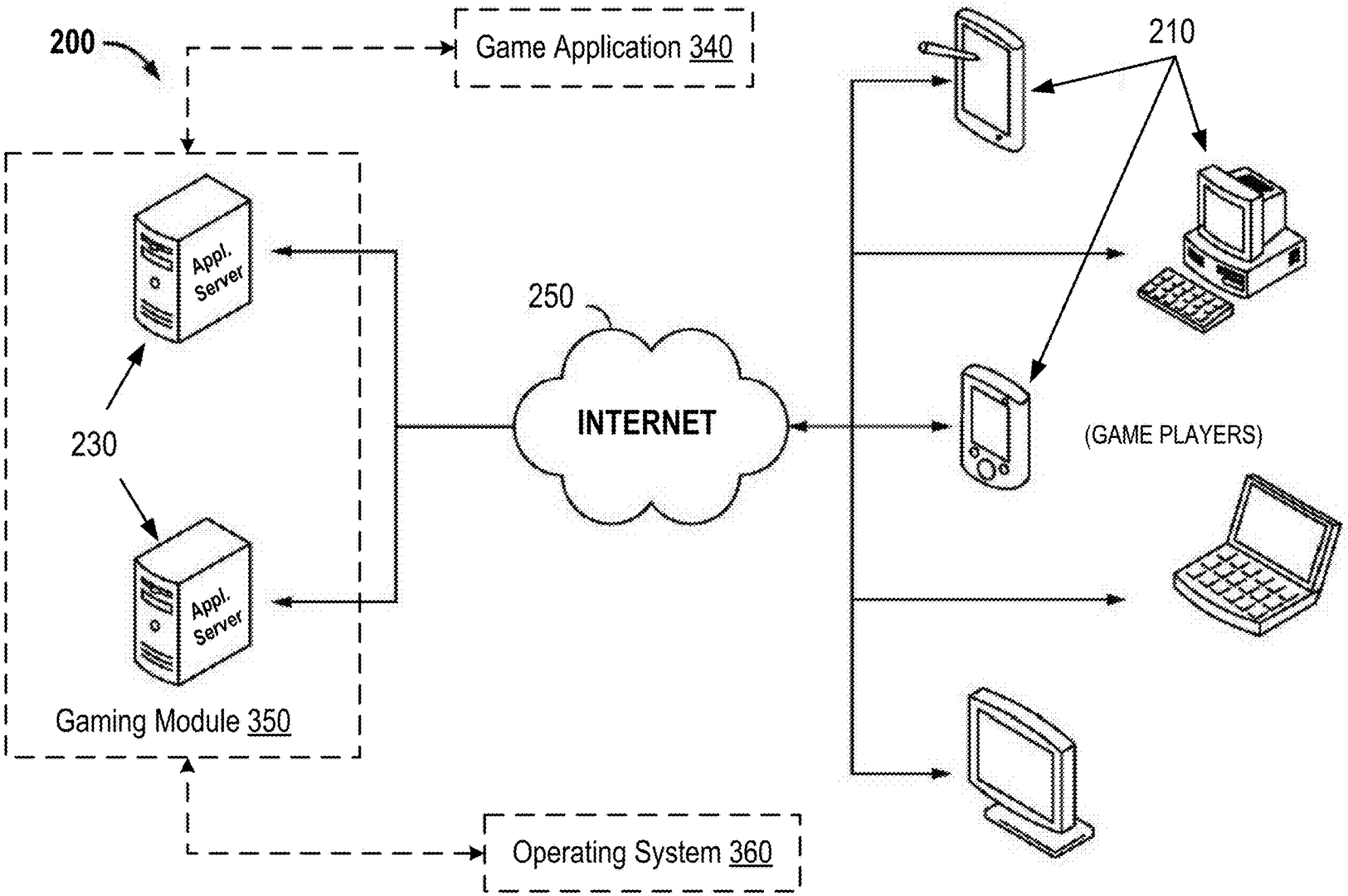
FIG. 9 is a block diagram of a computer system for implementing the example method and system as shown and described in FIGS. 7 and 8.
Figure 10:
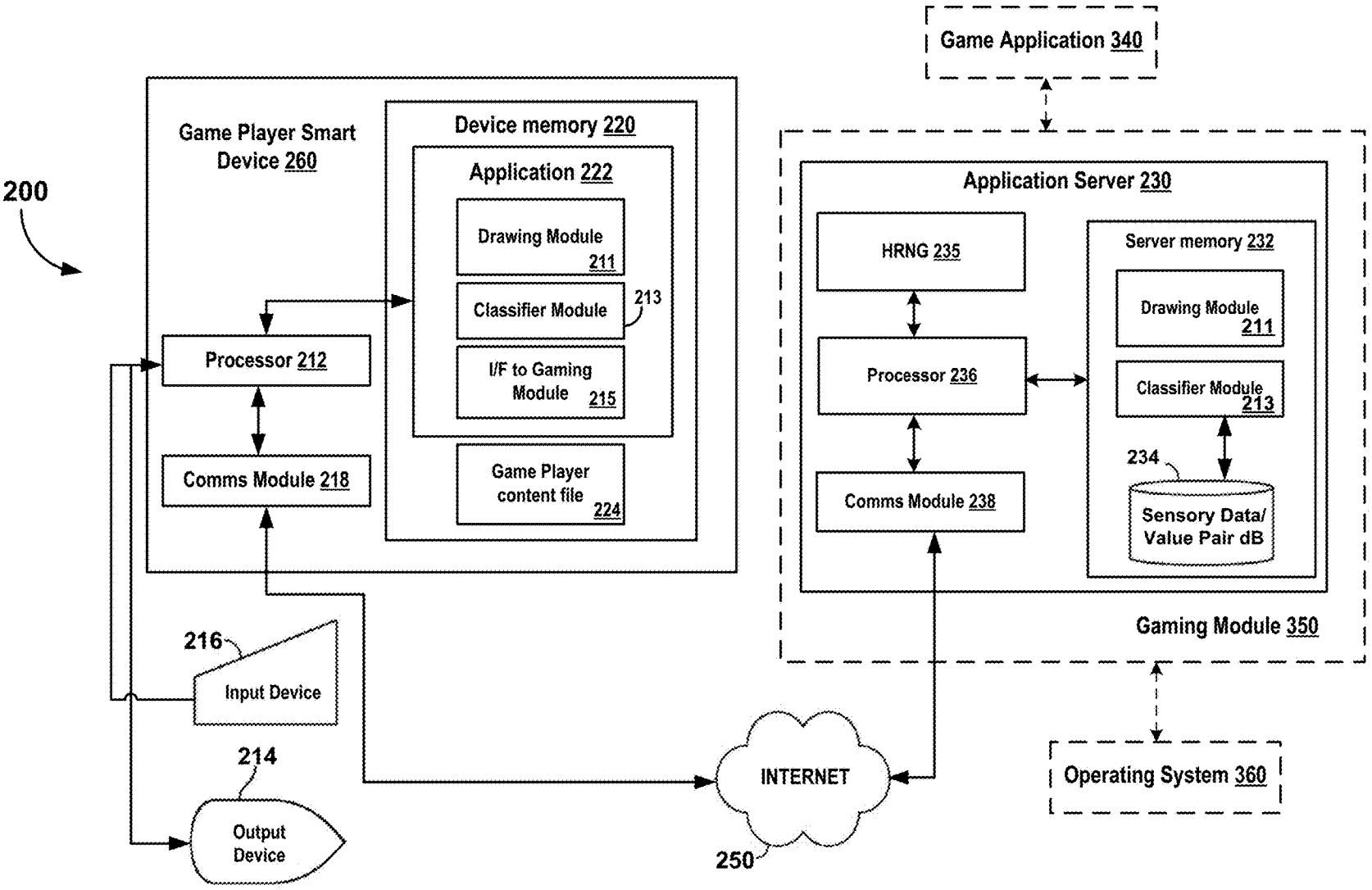
FIG. 10 is a block diagram illustrating an example client and server relationship from the computer system of FIG. 9 according to certain aspects of the disclosure.

The example computer system 200 described herein can include clients and servers. A client and server are generally remote from each other and typically interact over a communication network. The relationship of client and server arises by virtue of computer programs running on the respective computers and having a client-server relationship to each other. FIG. 9 is a block diagram of a computer system for implementing the example method and system as shown and described in FIGS. 7 and 8, and FIG. 10 is a block diagram illustrating an example client and server relationship based on the computer system of FIG. 9 according to certain aspects of the disclosure. Reference to FIGS. 7-10 should be made for the following description.

The techniques described in the following example embodiments may also be implemented in a distributed computing system that includes a back-end component, e.g., as a data server, and/or a middleware component, e.g., an application server or proxy web server, and/or a front-end component, e.g., a client computer having a graphical user interface and/or a Web browser through which a user can interact with an implementation of the invention, or any combination of such back-end, middleware, or front-end components. The components of the system can be interconnected by any form or medium of digital data communication, e.g., a communication network. Examples of communication networks include a local area network ("LAN") and a wide area network ("WAN"), e.g., the Internet, and include both wired and wireless networks.

Referring now to FIG. 7, there is described an example method 1000 whereby, in one embodiment, game players 210 conduct game play on gaming machines 300 of gaming-interface organizations that distribute games, or in another embodiment participate in game play with a gambling or non-gambling establishment (such as a wildlife conservation or preservation establishment) via a downloadable app on their smart electronic device (also represented as element 210 to reflect a device of the game player (e.g., PC, laptop, PDA, smartphone, smart watch, etc.)).

Before describing the subroutines and/or steps that comprise the example method 1000, and in reference to FIG. 8, the system 200 includes a plurality of sensors 202 arranged in the zone of interest (ZOI) related to game play of a particular game iterated by the Game Application 340 under control of the Gaming Platform 345 (Gaming Module 350 and Operating System 360). These sensors 202 are designed to capture sensory data 204 within the ZOI, for the later verification, classification and bonus evaluation sub-processes as detailed hereafter.

Each sensor 202 within the ZOI is to be assigned a value C1 . . . C(n), hereafter occasionally designated as "value 201", each value 201 to be randomly generated in some sequence by a hardware random number generator (HRNG) 235. HRNG 235 may, for example, be embodied by a true Quantum Random Number Generator (QRNG) chip, which offers perhaps the highest attainable security and robustness for the generation of random bits. One example may be the QRNG chip offered by QUANTIS® of Geneva, Switzerland where, in addition to its use in automotive, computing, critical infrastructure, IoT, mobile, and security applications, is tailor-made for use in gaming applications.

At its core, the QRNG chip contains a light-emitting diode (LED) and an image sensor. Due to quantum noise, the LED emits a random number of photons, which are captured and counted by the image sensor's pixels, giving a series of raw random numbers that can be accessed directly by the user applications. These numbers are also fed to a random bit generator algorithm (RGB) which distills further the entropy of quantum origin to produce random bits in compliancy to the NIST 800-90A/B/C standard.

Hereafter, and solely for purposes of explanation of the exemplary method 1000, the sensory data 204 may be referred to as still images (hereafter "image 204"), and each of the sensors 202 designed to capture these images 204 are referred to as motion activated cameras or camera traps (hereafter "camera 202"), such as the mounted field camera 10 described previously in FIGS. 3 and 4.

In an example, cameras 202 may be located in areas (i.e., a ZOI 255) specifically selected or approved for use of the system 200. The images 204 that are extracted from these cameras 202 may be input into a classifier module 213 of the system 200, as iterated by an application server 230 within Gaming Module 350 (or via an application server 230 of a system remote to the gaming machine 300) for the purpose of game play. As to be hereafter described, the classifier module 213 is configured to perform various verification, classification, and bonus evaluation subroutines. The ZOI 255 for the cameras 202 may be embodied as a location or site area of select habitat qualities that would prevent the capturing of identical images 204 by cameras 202 to trigger simultaneously, unless the game play required such identical image data.

As noted in the background of the invention, these camera traps (typically set up by conservationists, land owners, and/or researcher) collectively already take millions of photos or images and continue to gather more image data information every day. Yet most of these photos and image data are not effectively shared or analyzed, omitting valuable insights.

Accordingly, the method and system according to the example embodiments envision employing the use of artificial intelligence or machine learning in association with cameras 202 to facilitate aggregating, verifying and/or classifying, and analyzing images 204 captured by all the cameras 202 in the ZOI 255. As merely one non-limiting example of how deep learning technologies can be incorporated into the method 1000 and system 200 in accordance with the example embodiments, GOOGLE®, through their Google Cloud, provides access to an AI-enabled platform that streamlines conservation monitoring of wild animals.

Known as WILDLIFE INSIGHTS®, this Google AI platform streamlines conservation monitoring by speeding up camera trap data analysis. Researchers who have camera trap data can now upload them to the Google Cloud-based platform, where they can manage, identify, and analyze their biodiversity data. Researchers can also run AI models over their data for species identification. Using an open source framework, Google has trained AI models to perform two primary tasks: blank image filtering and species classification.

Blank image filtering. Wildlife researchers report that many hours are spent doing the arduous manual task of eliminating blanks from a dataset; that is, filtering out images without animals. The AI models which may be employed as described above may employ blank image filtering techniques to accurately classify blanks, while reducing the possibility of removing valuable images of animals. Google's AI models can achieve a near 99% confidence when predicting the blank class, i.e., the probability that it is actually a blank is very high.

Species Classification. Google's AI models have been trained to learn to recognize hundreds of species from around the world, facilitated in part by a number of unprecedented partnerships among organizations who have spent decades collecting, cataloguing, or labelling animals in camera trap images. This is a high-quality training dataset for AI models, consisting of over 8.7M images, larger than all the world's vertebrate specimen in museums combined.

Multiple image/audio datasets may be used to train the AI model(s) employed in accordance with the example embodiments. As an example, the AI models can be trained on images from Conservation International's Tropical Ecology and Monitoring (TEAM) Network. Snapshot Serengeti (3.2 million images, 48 animal categories) Caltech Camera Traps (245,000 image from 140 camera traps in the southwestern US); North American Camera Trap Images (NACTI dataset of 3.7M camera trap image with 28 animal categories), WWF and One Tam (includes 614 species from around the world).

Referring now back to FIG. 7, in the method 1000, prior to game play the Game Application 340 indicates, to the HRNG 235 in system 200, specific parameters for the numbers or values being requested, including the sequence (step S1010) as to be iterated by a drawing module 211. The sequence called by the drawing module 211 of system 200 (sequence in which the cameras 202 within the ZOI 255 are triggered by detected animal movement (as one triggering example)) determines the order of the values called in a drawing iterated by the drawing module 211. In other words, each camera 202 is randomly assigned a number (value 201) before every game by the HRNG 235. A given camera 202's snapshot or video function may be triggered by an animal occupying or traveling through the ZOI 255 where the camera 202 is located (on movement). The sequence in which these numbered cameras 202 are triggered determines the order in which their assigned numbers are called in a random drawing (by the drawing module 211).

As examples of instruction, the Gaming Application 340 may relate the numbers and sequence for randomly generated values 201 for a lottery as "draw six (6) unique integers from the set of integers 1 to 44 inclusive". The selected integers are then presented in ascending orders. In a game of bingo, the instruction might be "draw until bingo, unique integers from the set of integers 1 to 75 inclusive". Here the integers are used in the sequence they are drawn. As another example game, for slots the instruction might be "draw perpetually integers from the set of 1 to approximately 4 billion". Here, the number drawn is based on when a game player 210 hits the spin button in a slots game on the gaming machine 300. Similarly for roulette the instruction might be "draw one integer from the set of integers 0 to 36 inclusive", and so on. Accordingly. and for games of chance such as these above, for example, the timestamp for each triggered camera 202 is material to the outcome of a given game play.

Referring again to FIG. 7, under instruction for the Gaming Application 340, the HRNG 235 randomly assigns the values 201 to the sensors 202 within the ZOI 255 for a given game (step S1020). The HRNG 235 assigns a number to each camera 202 before every game so as to provide security and to serve as a protection against the bias of an animal triggering the same camera 202 more frequently because of habitat, water source, baiting, etc. Thus, the HNRG 235 is configured so as to be able to randomly generate any numbers or sequences of numbers (values 201) for any gaming application, either locally (at the gaming machine 300) or online-based via a downloadable application. The Gaming Application 340 (depending on the game it is running) then decides the criteria at which to allocate cameras 202 with their corresponding assigned C1 . . . C(n) (values 201) within the ZOI 255 to participating game players 210 (step S1030).

Game play commences and the cameras 202 in the ZOI 255 are triggered, whereby for each captured image 204, its timestamp at which its corresponding camera 202 is triggered determines the order of the values 201 called by the drawing module 211 in a drawing (step S1040). Recall that each camera 202 was randomly assigned a number (value 201) before the game by the HRNG 235. Upon its triggering by animal through the ZOI 255 where the camera 202 is located, a timestamp is created for that captured image 204. The sequence in which these numbered cameras 202 are triggered (based on timestamp) therefore determines the order in which their assigned numbers are called in a random drawing (by the drawing module 211). The RNG generated value 201 for each camera 202, together with its captured image 204 ("image/value pair"), are subsequently input to a sensory data/value pair database (step S1050), hereafter "database 234", in accordance with the sequence called by the drawing module 211.

In the example method 1000, the classifier module 213 accesses database 234 to conduct a sorting procedure, in which the image 204 in each of the stored image/value pairs is verified and classified (step S1060), and for those verified and classified images 204, thereafter conducts a bonus evaluation (step S1070) to determine which of the image/value pairs satisfy or pass so as to receive a bonus classification. Thus, during these sorting steps, if the game assigns bonuses to certain categories of images 204, then each given image 204 is analyzed in classifier module 213 to determine if the captured image 204 falls under a bonus classification. If so, bonuses may be awarded to game players 210 with a "winning image" by Gaming Module 350. As an aside, part of the sensory data that triggers the random drawing may be distributed to a game player's 210 gaming device (see FIG. 6) or to a smart electronic device of the game player 210, as shown in FIG. 8. Verified and classified sensory data thus serve as game play components.

Figure 2:
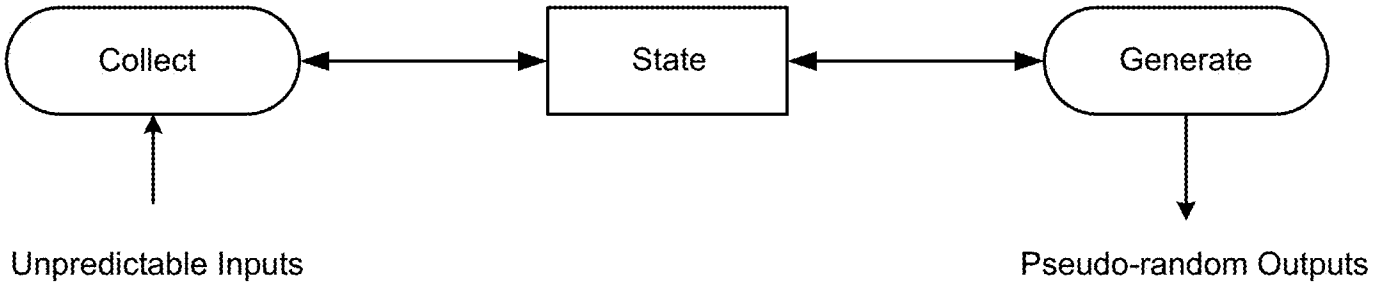
FIG. 2 a block diagram of a prior art pseudo RNG model.
Figure 11:
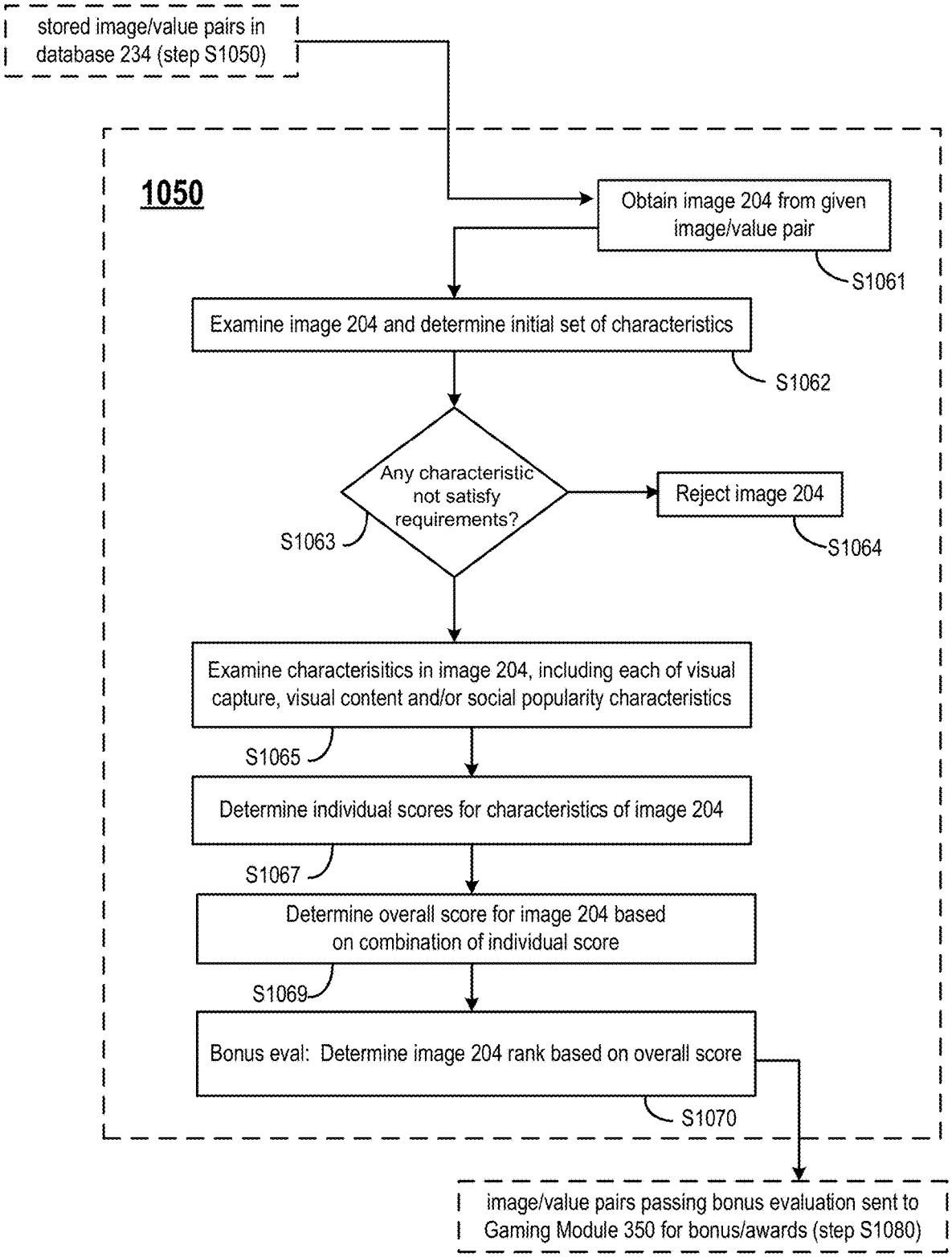
FIG. 11 is a flow diagram illustrating exemplary verification and classification subroutines to rank, select, and provide bonus-classified images for a given game, to the Gaming Module, from the set of stored image/value pairs in database.

Namely, the classifier module 213 may iterate subroutines S1060 and S1070 in a manner as shown in the flow diagram of FIG. 11, which may be based on that described in U.S. Pat. No. 9,858,295 to Murphy-Chutorian, et al., entitled "Ranking and Selecting Images for Display from a Set of Images", the relevant portions of FIGS. 2 and 3 in the '295 patent being incorporated by reference herein. Referring to FIG. 11, there is shown a routine 1050 that can be implemented, for example, on application server 230 within the Gaming Module 350 (such as by the classifier module 213 as shown in FIGS. 8 and 10) and/or as part of an application 222 of a game player 210's smart electronic device (hereafter "smart device 260") where, as shown in FIG. 10, the application 222 is connected via a network, the internet 250, the cloud, etc. to the Gaming Module 350 for remote game play.

In some implementations, the routine 1050, or portions thereof, can be initiated automatically by computer system 200. For example, the routine 1050 (or portions thereof) can be periodically performed, or performed based on one or more particular events or conditions, e.g., an application 222 being opened by a game player 210, receiving one or more images 204 that have been newly uploaded to or accessible by the system 200, a predetermined time period having expired since the last performance of routine 1050, and/or one or more other conditions occurring which can be specified in settings of a system.

In some implementations, such conditions can be specified by a game player 210 in stored custom preferences of the game player 210 within application 222. In one example, a server system can receive one or more images uploaded from one or more cameras 202, and can perform the routine 1050 for the newly-uploaded images. In another example, the classifier module 213 can perform the routine 1050 for a large collection of stored images 204. In a further example, in lieu of fixed and mounted cameras 202 within the ZOI 255, a smart device can send a captured image to a server (such as application server 230) over a network, so as to process the image 204 using routine 1050. Some implementations can initiate routine 1050 based on game player 210 input. A game player 210 may, for example, have selected the initiation of routine 1050 from a displayed user interface, e.g., a social networking user interface, application user interface, or other user interface. In some implementations, routine 1050 or portions thereof can be performed with guidance by the game player 210. For example, a game player 210 may be able to designate a set of multiple input images 204 to be processed by routine 1050.

Returning to FIG. 11, each captured image 204 stored in database 234 is obtained therefrom (step S1061) and subject to the following sorting processes. As an input to step S1062, the routine 1050 obtains an image 204 for processing. In some implementations, classifier module 213 can determine which image to select based on evaluating one or more characteristics of accessible images 204. e.g., timestamps and other metadata of images, the color distributions of images, the recognized content or labels describing content in images, etc.

At step S1062, the classifier module 213 performs an initial analysis on the obtained image 204 so as to detect an initial set of characteristics of the image 204. In some implementations, the initial set of characteristics are those that require less computational resources (e.g., less computational intensity) to detect and determine in an image 204, as compared to other types of image characteristics which may be examined and scored later in steps S1065. S1067, and S1069 of routine 1050 below. For example, the computational resources can include processing time and/or system resources, e.g., memory or other storage space, hardware and software processing/computing resources, etc. For example, in some cases, examining the initial set of characteristics can allow classifier module 213 to exclude or reject (for further evaluation) an image 204 based on the examination of the initial set of characteristics (as explained in step S1063 below), which may allow an overall routine 1050.

The initial set of characteristics can include a variety of types of characteristics, including but not limited to privacy characteristic, e.g., whether an obtained image 204 has a public or private status. Another example of an initial characteristic can be the size of the image 204. For example, the resolution of the image 204 can be determined, e.g., specified as height and width dimensions of the image in number of pixels or in another format. A further example of an initial characteristic is a noise measurement of the image. For example, one or more noise detection and measurement techniques can be used to evaluate the color noise and/or other types of noise present in the image 204. In one example, color noise (e.g., chromatic noise) is unintended or undesired variation or changes in color values of pixels of an image and can be caused by, for example, lighting conditions under which images 204 are captured by a camera 202 (e.g., underexposed photographs), performance of camera components, image processing software or image conversions, and/or various other causes.

Yet another example of an initial characteristic is particular types of content depicted in the image. For example, the method can check for the presence of any of the particular types of content as determined by image recognition techniques or other image content analysis techniques. In one example, one particular type of content can be animal facial content, where one or more facial recognition techniques can be used to look for known patterns of facial landmarks.

Accordingly, at step S1063 the classifier module 213 checks whether any of the initial characteristics examined in step S1062 do not satisfy one or more predetermined requirements. In some implementations, some or all of the predetermined requirements can be based on one or more characteristics of images 204 that are considered desirable to continue the examination and scoring subroutines. In some implementations, some or all of the predetermined requirements can be based on one or more characteristics of images that are considered undesirable. e.g., which image characteristics can cause an image to be eliminated from the possibility of further examination and scoring if the required characteristics are present. For example, images that do not satisfy the requirements can be considered undesirable, as described below.

The privacy characteristic of the image can be associated with a requirement that the image have a public status privacy characteristic. This causes undesirable images to be images that have been designated or considered private status, e.g., by the owning or controlling users of those images not providing permissions to the establishment to use the images in a gaming application. In some implementations, by having a requirement of a public status, the image automatically passes the private/public initial requirement. In another example, a requirement for a size characteristic of the image can require that the image have a particular resolution (or other specified size) or larger, such that smaller-resolution images (e.g., having a resolution under a resolution threshold) do not meet the requirement and hence fail/are rejected (output of step S1063 is "NO"). This requirement causes desirable images to have a predetermined minimum size and eliminates smaller images (rejected at step S1064) from follow-on examination and scoring. In another example, a requirement for a noise characteristic of the image can require that the image have less than a threshold amount of noise, such that noisier images (e.g., having noise over the noise threshold) do not meet the requirement. This causes desirable images to have a maximum amount of noise that is considered acceptable and rejects noisier images from follow-on examination and scoring.

Accordingly, if any of the initial characteristics do not meet their requirements, the image 204 is rejected (at step S1064) and thus removed from further analysis for determining its rank for a possible bonus classification and award. For example, this can include associating and storing particular metadata (e.g., a flag, value, or other designation) with the rejected image indicating that it is rejected, and/or other rejected status. All images 204 that whose initial characteristics satisfy the requirements output of step S1063 is "YES") move on to examination at step S1065.

At step S1065, the routine 1050 proceeds to examine characteristics of the obtained image 204. These characteristics may include a wide variety of different image characteristics. In some implementations, these characteristics can include multiple different classes (e.g., categories) of image characteristics, including visual capture characteristics related to the visual appearance of the animal or other wildlife in the image 204 and its capture by the camera 202, visual content characteristics related to content depicted in the image (e.g., besides the animal, other objects, landscape features or areas, environments, etc.), and/or social popularity characteristics related to the popularity and opinion of the captured image 204 among game players 210 or a panel of social media wildlife experts.

In some examples, various implementations can examine all three of these classes of characteristics, two of these classes of characteristics, one of these classes of characteristics (and/or other classes), etc. In some implementations, certain classes of characteristics can be evaluated before other classes, e.g., to make the evaluation process more efficient with regard to processing time, storage, and/or other computing resources.

At step S1067, the routine 1050 determines individual scores for the examined characteristics of the obtained image 204. An individual score is an estimated measurement (e.g., value) for a characteristic as specified in a predetermined scale and indicating a rating for that characteristic, e.g., a magnitude of the strength or degree of presence of that characteristic in the image, a value indicating a degree that the characteristic deviates from an established baseline, etc. An individual score can be determined based on one or more factors or inputs related to the image that the method examines.

In various implementations, the routine 1050 can determine an individual score for each characteristic of the image (or class of characteristic) examined in Step S1067. In some implementations, an individual score can be determined for each of multiple types of characteristics within each of these classes of characteristics.

For example, if visual capture characteristics are one of a set of characteristics, these can indicate technical visual characteristics of the captured image 204, one or more of which may have been created at a time of capture of the image 204 by camera 202. e.g., due to environmental conditions of a physical area captured in the image 204, camera 202 characteristics and settings, etc. A first individual score may be determined by classifier module 213 based on evaluation of a set of visual capture characteristics.

Some implementations can include characteristics in the visual capture characteristics that are not related to image 204 capture, and which related to visual appearance of the image 204. In some examples, visual capture characteristics can include blurriness, exposure level, brightness, contrast, etc. For example, visual capture characteristics can include blurring (e.g., sharpness), where a large amount of blur in the image 204 can be considered lower visual quality and lower desirability. The visual capture characteristics can include exposure level, where a high or low image exposure level outside a predetermined range can be considered a lower visual quality and lower desirability. Similar characteristics can include image brightness, saturation and/or vibrancy (e.g., strength of colors in image 204), contrast, highlights (e.g., bright areas of image 204 with potential loss of detail), shadows (e.g., dark areas of image 204 with potential loss of detail), and/or other types of visual capture characteristics in the image 204. Such visual capture characteristics can be determined by examining the pixel values of the pixels of the captured image 204. The visual capture characteristics can include color noise (and/or other types of visual noise), where noise estimation techniques can be used.

In some implementations, the classifier module 213, in implementing step S1065, can determine the quality or desirability of one or more of the visual capture characteristics based on machine learning/AI techniques and training techniques, or AI models may altogether replace the functions of classifier module 213. For example, machine learning and training techniques (such as the aforementioned AI models) can use ratings or judgments by game players 210 or other persons (certified or expert researchers in a particular species field) made on a large number of images as to their appeal and/or quality. As an example, an AI module may incorporate recognition software, in conjunction with or without a human authority of recognized standing. If a game has assigned bonuses for the image of a particular species, such as a bear or puma, the steps S1060 and S1070 of FIG. 7 can be performed in an automated way using AI/ML techniques. Thus, the AI/ML technique(s) can be trained to find the values or patterns of visual capture characteristics in images that correlate with user approval of those images, e.g., the system can learn which characteristic values or patterns are indicative of higher visual quality.

The technique can examine newly stored and unrated images 204 from database 234 to search for approved characteristic values or patterns and determine a desirability of the visual capture characteristics. Some implementations can examine pixel values (such as color and brightness values) and/or structures (e.g., edges and textures) or image features (e.g., content features) detected in the pixels. For example, a visual capture characteristic can include image composition, where the captured image 204 can be scored based on the location of a main subject(s) in the image 204 (e.g., a particular content feature) with respect to the borders of the image 204, with respect to other content features in the image, etc. In some implementations or cases, visual capture characteristics can be determined based on one or more local regions in the image 204 composed of multiple pixels, e.g., image areas smaller than the entire area of the image 204.

Another class of characteristics evaluated by routine 1050 as implemented by classifier module 213 may be a set of visual content characteristics. These may include animal facial content characteristics and landmark content characteristics, whereby a second individual score can be determined for animal facial visual content, and a third individual score can be determined for landmark visual content.

Namely, visual content characteristics can indicate types and other attributes of content features depicted in the image 204, including animal facial content characteristics, objects, structures, landmarks, landscape areas or regions, etc., referred to as "content" or "content features" herein. Content features can be detected and recognized in the image 204 based on any of various known image recognition techniques, including facial recognition techniques, landmark recognition techniques (e.g., well-known landmarks), landscape recognition techniques (e.g., foliage, mountains, lakes, etc.), object recognition techniques (e.g., vehicles, buildings, articles, etc.). For example, image recognition techniques can examine the image 204 for predetermined patterns, can compare portions of the image to reference patterns, can examine the image 204 for image features such as animal facial content (eyes, nose, mouth, horns, gills, etc.), particular colors at particular positions in the image 204 (e.g., blue at top of image indicating sky), etc. Location data (e.g., metadata of images indicating a geographic location at the ZOI 255 where the image 204 was captured) can be used to assist recognition of particular types of content features such as game areas, parks, bodies of water, etc.

A further class of characteristics evaluated by routine 1050 as implemented by classifier module 213 may be a set social popularity characteristics for the evaluated captured image 204. These can be characteristics indicating the social popularity of the image 204 to one or more of the game players 210 and/or research and wildlife human authorities of recognized standing for a particular species ("experts"), based on social data provided by the game players 210 or experts to system 200 with respect to the image 204. In various implementations, the social popularity characteristics can include, for example, the number of game players 210 or experts that have viewed the image over social media, the number of times the image 204 has been viewed over social media by the game players 210 or experts, and/or the length of the times the image 204 has been viewed by the game players 210 or experts. In some examples, the time length of viewing can be determined using timestamps associated with each stored, captured image 204, thereby indicating the times when the image 204 was first captured by a camera 202.

Social characteristics may include a share count, e.g., the number of times that the image has been shared over social media between game players 210 or experts with each other of with other persons in their social networks, collectively "viewers". For example, sharing an image 204 can occur between game players 210 or experts sharing the same network service, or between network services, or over other communication forms such as email, text messages, etc. In some implementations, the share count can includes "re-shares," e.g., sharing a previously-shared image such as in a retweet, where, for example, a second game player 210, expert, or other person in the network receives the image in a shared communication from a first user, and then the second user re-shares the image to a third user.

The social characteristics can include a rating count, e.g., the number of ratings given to or otherwise associated with the image 204 by viewers indicating an opinion or recommendation of the image 204 by those viewers. For example, the rating count can include the number of times that the image has been positively rated by one or more viewers through a network service, indicating approval or praise of the image by those viewers. In another example, the rating count can include the number of times that the image has been rated to indicate one or more particular opinions of the image, e.g., disapproval, approval, recommendation, indifference, etc. For example, a viewer opinion of the image can be expressed in a binary form (e.g., approve or disapprove), or in a predetermined numerical scale and range. e.g., a value in a range from 1 to 5, 1 to 10, −5 to +5, etc. Other rating information can also be included in social popularity characteristics, such as the time elapsed between the occurrence of each rating of the image and the last rating of the image, the number of repeat ratings by the same viewers, etc.

Additionally, the social popularity characteristics may include the number of times the image 204 has been put on a viewers' favorite lists, bookmark lists, and/or other lists by viewers. The social popularity characteristics can include the number of comments about the image 204 by viewers (e.g., whether positive or negative). For example, some network services can allow viewers accessing the network service to make online comments related directly to a posted image 204. In some implementations, this may include finding the number of positive comments and the number of negative comments for the image 204, e.g., by checking comments for predetermined words or phrases considered positive and negative, etc. In some implementations, social popularity characteristic data can be stored separately from the image and associated with the image 204, e.g., with one or more links allowing access to the data.

In some implementations, an individual overall score is determined (step S1067), which can be an individual score that is a combination (e.g., sum, average, mean, etc.) of multiple individual scores determined for the multiple types of characteristics within a characteristic class, as described in step S1065. For example, each of the scores determined for the class of visual capture characteristics, class of visual content characteristics, and class of social popularity characteristics to provide a total individual score for the image 204.

Some implementations can weight these types or classes of individual scores, prior to combining each of the scores, differently than other types or classes, e.g., to adjust the influence of different types and/or classes of characteristics to a combined individual score. In one example, individual scores can be weighted in a predetermined manner. Various implementations can impart weights to individual scores in different ways.

In some examples, machine learning techniques can be used to determine how to weight each of the individual scores. For example, a large number of images having the characteristics described above can be judged by human judges (e.g., the aforementioned research and or wildlife experts), and the amount that a particular characteristic contributes to the highest quality images can be estimated based on correlating high quality images with each of the characteristics.

In some examples, particular values of the social popularity characteristics may be found to be highly correlated with images judged to have the best overall visual quality or appeal. As a result, the social popularity characteristics can be weighted so as to have a larger influence than other characteristics that are not as correlated. Visual capture characteristics may be found to also be correlated with judged high quality images, but may be found to be overall less correlated than the social popularity characteristics. The method can weight visual capture characteristic individual score(s) by a less influential amount than the social popularity characteristic individual score(s). In another example, the visual content characteristic individual score(s) can be weighted to be more influential if it is important for a system that undesired types of content features not be depicted in selected and displayed images. In some implementations, each of the individual scores can be weighted by a different amount in the determining of the overall scores.

Referring again to FIG. 11, at step S1069, the classifier module 213 determines an overall score for the image 204 based on a combination of the individual scores determined in step S1065. In some examples, the combination can be a summation, average, mean, or other combination of the individual scores. In some implementations, routine 1050 can assign weights to individual scores of different characteristics to increase or decrease the influence of those characteristics to the overall score.

In some implementations, the weights can be based on previous actual observations by persons of the amount of influence of particular characteristics to the evaluation of visual appearance of images by users in general. For example, previous observations by persons may have determined that social popularity has a more significant influence on perception of an image than does capture characteristics, such that social popularity characteristics are weighted higher in determining the overall score. Some implementations can use machine learning or training of the routine 1050 to combine the individual scores into an overall score.

At step S1070, the classifier module 213, for each of the captured images 204 that through examination has been verified and classified and accorded an overall score, determines a rank of the obtained images based on their overall score determined at step S1069. In some implementations, during game play that image 204 with the highest overall score is given a bonus classification. In other implementation, multiple images 204 with ranking exceeding a designated rank threshold are accorded a bonus classification.

Accordingly, the rank can be determined by comparing the overall score of a given image 204 to overall scores associated with other images that have been examined, scored, and ranked. Further, for all bonus-classified images, a list of these images could be provided to participating game players 210, together with certain characteristics. e.g., ranked according to their overall quality. e.g., general visual appeal based on the characteristics described above such as visual capture characteristics, visual content characteristics, and social popularity characteristics.

Alternately, instead of a classifier module 213, steps S1060 and S1070 may be performed manually, one example being in the form of an evaluation by subject matter experts such as conservation biologists who review images of animals, birds, and/or fish. Imagery or audio files may be verified and classified by photo or audio interpreters that are experts in their particular field of study. In a further alternative, captured imagery can be verified and classified manually by non-experts.

Referring again to FIG. 7, for all bonus-classified images 204, the corresponding image/value is received by the Gaming Module 350 (step S1080), so that a bonus, jackpot, award, or otherwise winnings (cash, credit, virtual reward) is conveyed (step S1090) to the winning game players 210, either at of a gaming machine 300, or via a smart device 260, as shown in FIG. 8. Jackpots, bonuses, etc. may include special audio/visual treatments that incorporate the image 204 that triggered the "winning" camera 202 randomly assigned via its value 201 the game player. In one example, bonuses may be awarded for sensory data that is rare and visually compelling (e.g., image capture of an endangered species). In another example, bonuses may be awarded by the gaming interface module 1006 for a combination of images captured. For example, it can be determined that cameras 202 being triggered by two white-tailed deer followed by a skunk and an owl will add a bonus to the game. A bonus system can be integrated with an existing game or be appended to the play as an additional game or side bet.

Referring now to FIGS. 9 and 10, computer system 200 includes one or more application servers 230 and one or more client or game player computing device(s) 260 ("smart device 260" for brevity) connected over a network, here shown as the internet 250. Internet 250 may be any network topology, including one or more of a personal area network (PAN), a local area network (LAN), a campus area network (CAN), a metropolitan area network (MAN), a wide area network (WAN), a broadband network (BBN), and the like.

At least one of the application servers 230 is configured to host a database (or portions thereof). The application servers 230 are configured to perform game player 210 authentication, the storing of financial plans, and to interface with third-party providers to perform function including but not limited to financial account aggregation, information lookup, etc.

Application server(s) 230 can be any device having an appropriate processor, memory, and communications capability for hosting the database 234. The smart devices 260 to which the servers 230 are connected over the internet 250 can be, for example, desktop computers, mobile computers, tablet computers (e.g., including e-book readers), mobile devices (e.g., smartphones or personal digital assistants), set top boxes (e.g., for a television), video game consoles, any other devices having appropriate processor, memory, and communications capabilities, and/or any computing device configured with a JAVASCRIPT engine, a processor and storage.

As shown in FIG. 10, the smart device 260 and the server 230 are connected over the internet 250 via respective communications modules 218 and 238. The communications modules 218 and 238 are configured to interface with the internet 250 to send and receive information, such as data, requests, responses, and commands to other devices on the network. The communications modules 218 and 238 can be, for example, CPUs with embedded WIFI or cellular network connectivity (one example CPU being the QUALCOMM® SNAPDRAGON™ 821 processor with X12 LTE), modems or Ethernet cards. The server 230 includes a processor 236, a communications module 238, and a memory 232 that includes the sensory data/value pair database 234.

The processor 236 of server 230 is configured to execute instructions, such as instructions physically coded into the processor 236, instructions received from software in memory 240, or a combination of both. Processors 212 and 236, so as to be suitable for the execution of a computer program may include, by way of example, both general and special purpose microprocessors, and any one or more processors of any kind of digital computer. Generally, a processor will receive instructions and data from a read-only memory or a random access memory or both. The essential elements of a computer are a processor for executing instructions and one or more memory devices for storing instructions and data. Generally, a computer will also include, or be operatively coupled to receive data from or transfer data to, or both, one or more mass storage devices for storing data, e.g., magnetic, magneto-optical disks, or optical disks. Information carriers suitable for embodying computer program instructions and data include all forms of non-volatile memory, including by way of example semiconductor memory devices, e.g., EPROM, EEPROM, and flash memory devices; magnetic disks, e.g., internal hard disks or removable disks; magneto-optical disks; and CD-ROM and DVD-ROM disks. The processor and the memory can be supplemented by, or incorporated in special purpose logic circuitry.

To provide for interaction with a game player 210, the embodiments described herein can be implemented on computer system 200 via a display device, e.g., a CRT (cathode ray tube) LED (light emitting diode), or LCD (liquid crystal display) monitor, for displaying information to the game player 210 and a keyboard and a pointing device, e.g., a mouse or a trackball, by which the game player 210 can provide input to the computer (e.g., interact with a user interface element, for example, by clicking a button on such a pointing device). Other kinds of devices can be used to provide for interaction with a game player 210 as well; for example, feedback provided to the game player 210 can be any form of sensory feedback, e.g., visual feedback, auditory feedback, or tactile feedback; and input from the game player 210 can be received in any form, including acoustic, speech, or tactile input.

A game player 210 can enter a mode to select content or activate a function in a phone application 222 downloadable onto their smart device 260 from the application server 230 via network 250, to be stored in memory for access by using a trigger, such as a long press on a touchscreen input device 216 or pressing the CTRL key and a mouse button on a keyboard and mouse. In certain aspects, a game player 210 can automatically click on the application 222 once downloaded from the APPSTORE/PLAY STORE.

For example, content in a game player content file 224 associated with the downloaded application 222 for display on the output device 214 of the game player 210's smart device 260 can be accessed using an input device 216 such as a touch screen or pointing device (e.g., a mouse). Functions or outputs of the downloaded application 222 graphically shown on the output device 214 can be triggered by the game player 210's finger where the input device 216 is a touch input, or with a cursor when the input device 216 is a mouse, or with the game player's eyes when the input device 216 is an eye tracker. Alternatively, functions or outputs of the downloaded application 222 graphically shown on the display can be triggered based on the game player 210's facial or physical expression when the input device 216 is a camera with appropriate gesture tracking technology, by the game player 210's voice when the input device 216 is a microphone with appropriate voice recognition technology, or by the game player 210's thoughts when the input device 216 is a brain-computer interface.

Figure 12:
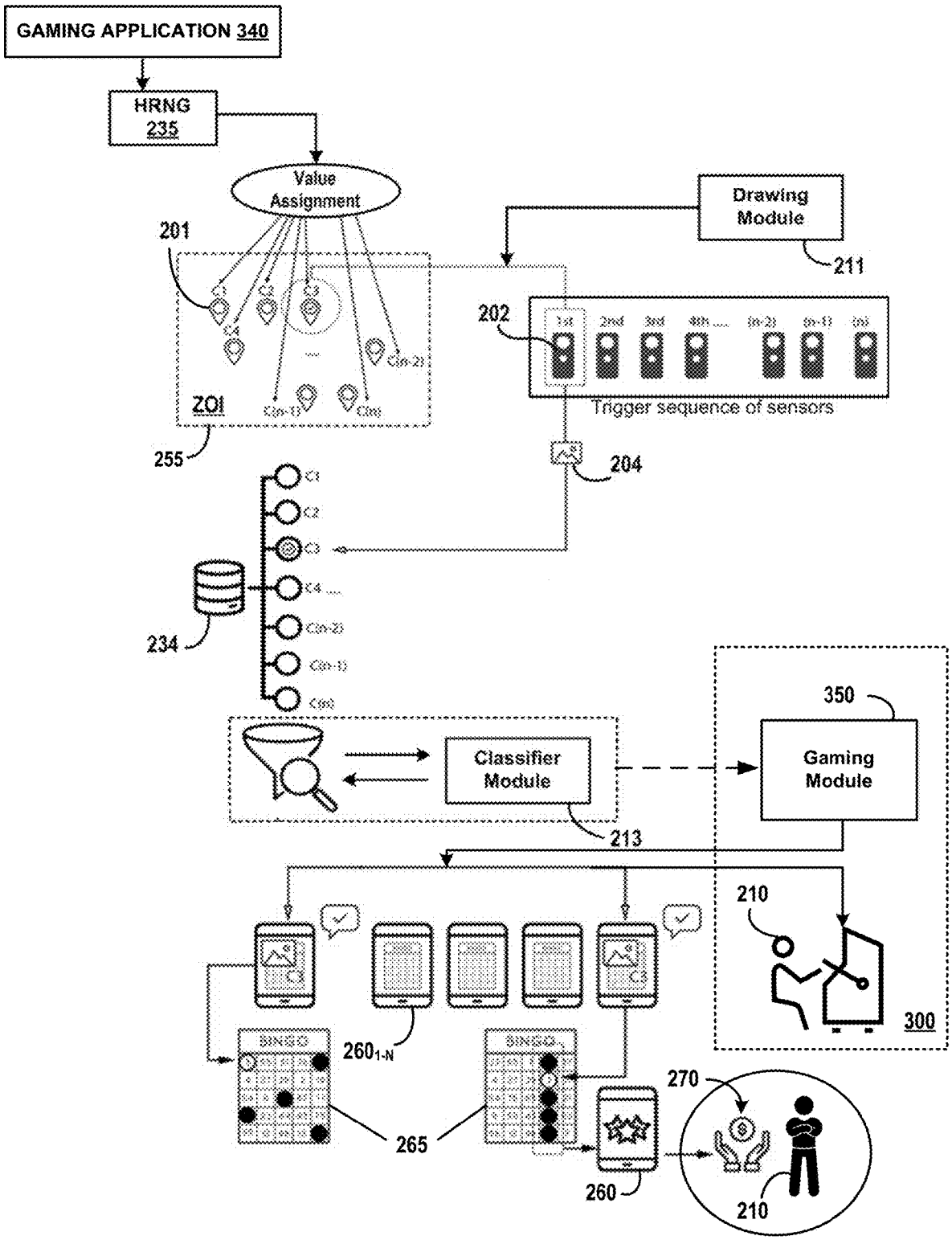
FIG. 12 is a block diagram similar to FIG. 8 in the context of an example bingo gaming application.

FIG. 12 describes an application of the example method and system to a bingo game, with bingo players. Referring to FIG. 12, in the bingo application, values 201 assigned by HRNG 235 to the camera 202 include but are not limited to (i) numbers of a finite set. (ii) numbers of an infinite set. (iii) bingo values, (iv) proper names, (v) names having meaning in any variety of themed gambling games, or (vi) symbols. Identical values may be assigned to multiple cameras 202 to speed up or add variety to a game with limited unique values in the drawing. Cameras 202 may be added or removed from the game to control game play speed and/or to change the quality of the image data. A camera 202 may be assigned a randomly generated value 201 once, or a new value 201 before each game. Images 204 captured by cameras 202 located in more than one ZOI 255 may be used for game play.

In one example, the random drawing iterated in drawing module 211 based on the captured images 204 may be based on the chronological order (timestamps) of the triggered camera 202. Alternatively, image/audio classification types may have an intrinsic value so that the drawing is not based on the camera 202 that makes the image/audio capture, but the image 204/audio itself, regardless of the camera 202 that captured it.

Referring again to FIG. 12, the functions of how images 204 are captured, examined, scored and ranked mirror that as described in FIGS. 7, 8 and 10; thus a detailed explanation thereof is omitted for brevity. As noted, the verified and classified images subject to ranking and bonus classification provide game play data. If a game has assigned bonuses for the image of a particular species, such as a black bear or mountain lion, for those ranked images 204 of a black bear or mountain lion which that warrant a bonus classification, a bonus, award, winnings, etc. are conveyed to game players 210 with winning numbers (as assigned by the Gaming Application 340 in step S1030), via the Gaming Module 350.

Moreover, a winning image 204 may also be sent to a smart device 206 of a winning game player 210. Bonuses and jackpots, etc., may get associated special visual design treatments as previously described. When a game player 210 is notified that a number on their bingo card has been called, the player daubs their own bingo card 265. Winning cards 265 may call "Bingo" at which time bingo is verified, bonuses may be awarded and payouts 270 occur.

Figure 13:
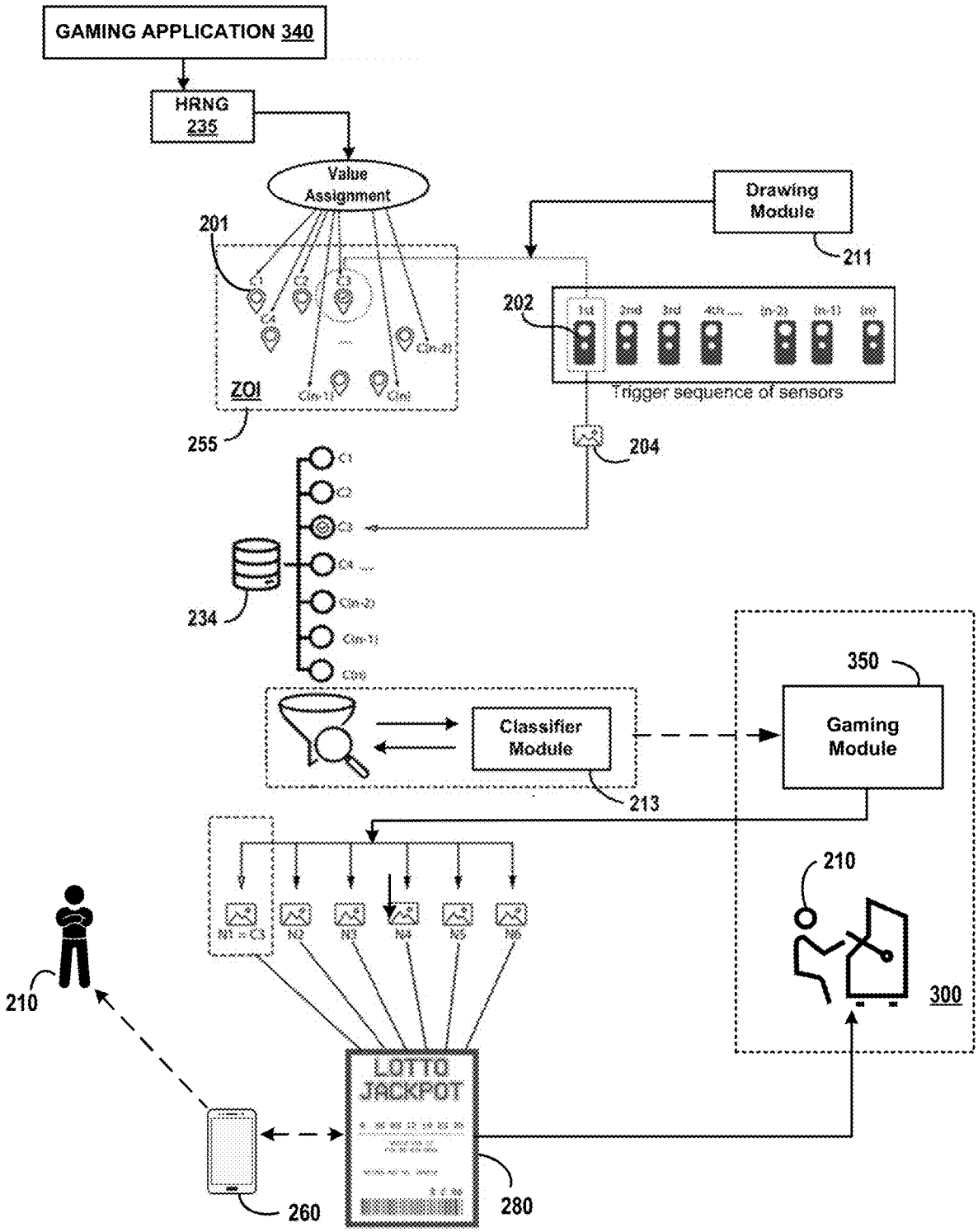
FIG. 13 is a block diagram of similar to FIG. 8 in the context of an example lottery gaming application.

FIG. 13 describes another application to a lottery game where users are the gamblers. Referring to FIG. 13, how images 204 are captured, examined, scored and ranked for bonus classification mirror that as described in FIGS. 7, 8, 10 and 12; thus a detailed explanation thereof is omitted for brevity.

If a game has assigned lottery winnings for the image of a particular species, such as a coral snake, for those ranked images 204 of a coral snake which that warrant a bonus classification, the lottery winnings may be conveyed to game players 210 with winning numbers at a gaming machine 300 (as assigned by the Gaming Application 340 in step S1030), via the Gaming Module 350, or via their smart device 260. Here as shown in FIG. 13, winning lottery tickets 280 may be redeemed.

The example embodiments heretofore described may offer several advantages and benefits. The method and system as configured link the real world to game play, and reward or compensate property owners and land owners, tenants, or organizations that control areas where sensory data may be captured as part of the iteration of the example method described herein.

The linking of revenue generation (such as rewards, bonuses and compensation) to participants using the example method and system (participants who may owners of the sites), may serve to enhance the population health of species and richness of the sites' biodiversity to owners in control of select areas or habitat areas. Additionally, the example method and system has the potential to increase game player participation and attract new players, while simultaneously providing a solution for making conservation of habitat areas a highest and best use.

It is anticipated the game play would increase because of one or more of (a) as compensation and jackpots accrue. (b) as more and diverse species are viewed by the players, (c) as habitat areas improve. (d) as the health of select species improve. (e) as certain species increase in number, (f) with those players that are concerned about species habitat, (g) with those concerned about the specific selected site, and/or (h) based on players seeking a real-world experience.

The gambling experience provided by the example method and system may attract additional players, as opposed to the standard donating or otherwise contributing to help species habitats or preserve and/or conserve sites. Moreover, the economics of gaming may be leveraged to achieve outcomes for habitats and select areas and targets potentially on par with competing economic enterprises. In turn, this could result in a revenue source that has the capability to increase highest and best uses on undeveloped areas or sites, with a force that counters forces competing for the same resources and sites. Further, the opportunity to link elements of the real world to a system of gaming permits connection with similarly identified elements connecting to the existing state of being drawn from actual events and siting, or targets, of the real world.

The present invention, in its various embodiments, configurations, and aspects, includes components, systems and/or apparatuses substantially as depicted and described herein, including various embodiments, sub-combinations, and subsets thereof. Those of skill in the art will understand how to make and use the present invention after understanding the present disclosure. The present invention, in its various embodiments, configurations, and aspects, includes providing devices in the absence of items not depicted and/or described herein or in various embodiments, configurations, or aspects hereof, including in the absence of such items as may have been used in previous devices, e.g., for improving performance, achieving ease and/or reducing cost of implementation.

The foregoing discussion of the invention has been presented for purposes of illustration and description. The foregoing is not intended to limit the invention to the form or forms disclosed herein. In the foregoing Detailed Description for example, various features of the invention are grouped together in one or more embodiments, configurations, or aspects for the purpose of streamlining the disclosure. The features of the embodiments, configurations, or aspects of the invention may be combined in alternate embodiments, configurations, or aspects other than those discussed above. This method of disclosure is not to be interpreted as reflecting an intention that the claimed invention requires more features than are expressly recited in each claim. Rather, as the following claims reflect, inventive aspects lie in less than all features of a single foregoing disclosed embodiment, configuration, or aspect. Thus, the following claims are hereby incorporated into this Detailed Description, with each claim standing on its own as a separate preferred embodiment of the invention.

Moreover, though the description of the invention has included description of one or more embodiments, configurations, or aspects and certain variations and modifications, other variations, combinations, and modifications are within the scope of the invention, e.g., as may be within the skill and knowledge of those in the art, after understanding the present disclosure. It is intended to obtain rights which include alternative embodiments, configurations, or aspects to the extent permitted, including alternate, interchangeable and/or equivalent structures to those claimed, whether or not such alternate, interchangeable and/or equivalent structures disclosed herein, and without intending to publicly dedicate any patentable subject matter.

We claim:

1. A computer system adapted for drawing random numbers based on outputs of sensors in games involving wildlife which have one or more participating game players, comprising:

one or more sensors arranged in various locations of a site area, each sensor covering a zone of interest (ZOI) in the site area, each sensor assigned a random number and triggered to capture an image upon an animal entering its ZOI so as to trigger the sensor, a random number generator (RNG) which, prior to commencement of game play, is configured to generate and assign values to each of the sensors in the site area, the one or more sensors represented as numbered sensors, a processing hardware set, and a computer-readable storage device medium, wherein the processing hardware set is structured, connected and/or programmed to run program instructions stored on the computer-readable storage medium instructions and associated data, the program instructions including:

a game application module programmed to allocate a respective numbered sensor to each of the participating one or more game players for game play, a drawing module programmed to call a sequenced drawing of the numbered sensors upon a triggering event resultant from a captured image of an animal in each of the numbered sensors' ZOI, a database for storing the assigned value corresponding to its numbered sensor along with the image captured upon the triggering event, a classification module programmed to analyze stored images to determine which of the stored images pass a criteria for bonus classification, and a gaming module programmed to convey an award to one or more of the game players associated with a numbered sensor whose captured image warrants a bonus classification.

2. The system of claim 1, wherein the game application contains specific game software applications for the actual game or set of games to be played.

3. The system of claim 2, wherein the game application further includes electronic, online and downloadable gambling applications designed for a game player to play games of chance or skill for money.

4. The system of claim 2, wherein the game application further includes social electronic, online, and downloadable non-gambling applications for game players having an interest of partaking in the social aspects of competitive games of chance or skill events without spending actual money.

5. The system of claim 1, wherein the one or more game players participate in an establishment at a gaming machine containing the game application and gaming module therein.

6. The system of claim 1, wherein the one or more game players participate in game play via a smart electronic device remote from the location of the gaming application and gaming module.

7. The system of claim 1, wherein a sequence in which the numbered sensors are triggered determine the sequenced order in which their assigned values are called in the drawing by the drawing module.

8. The system of claim 7, wherein the order of calling the assigned values of the numbered sensors is chronological by timestamp of each sensor's captured image.

9. The system of claim 1, wherein the image that is captured is selected from a group consisting of any of a still image, a single image, a frame in a video sequence of video frames, with and without audio, and an image in a different type of sequence of images.

10. The system of claim 1, wherein the sensor is a motion-activated camera or camera trap designed to capture an image upon animal movement in its view.

11. The system of claim 1, wherein the sensor is selected from a group consisting of any of a motion-activated camera, a camera set on a timer, a video camera, a heat sensor, an infrared sensor, an infrared camera, a satellite image camera, a spectral data camera, a digital camera, a film camera, radar imagery, a sonar sensor, a traffic camera, a car-mounted camera, a security camera, a web-type camera, an audio sensor, and an audio recording device.

12. The system of claim 1, wherein the game application, prior to commencement of game play, instructs to RNG as to specific parameters for the random generation and assignment of values to the sensors.

13. A computer-implemented method for drawing random numbers based on outputs of a plurality of sensors in games involving wildlife which have one or more participating game players, comprising:

arranging a plurality sensors within a site area, each sensor covering a specific zone of interest (ZOI), assigning each sensor a randomly generated number value, calling a sequenced drawing of the numbered sensors upon a triggering event resultant from a captured image of an animal in each of the numbered sensors' ZOI, storing the assigned value corresponding to its numbered sensor along with the image captured upon the triggering event, analyzing the stored images to determine which of the stored images pass a criteria for bonus classification, and conveying an award to one or more of the game players associated with a numbered sensor whose captured image warrants a bonus classification, wherein the assigning, calling, storing, analyzing, and conveying steps are performed by computer software adapted to run on computer hardware.

14. The method of claim 13, wherein a sequence in which the numbered sensors are triggered determines the sequenced order in which their assigned values are called in the drawing.

15. The method of claim 14, wherein the order of calling the assigned values of the numbered sensors is chronological by a timestamp of each sensor's captured image.

16. The method of claim 13, wherein analyzing further includes, for each stored image:

examining a first set of initial characteristics for the image and rejecting the image if requirements for at least one of the set of initial characteristics is unmet, otherwise examining a second set of characteristics different from the first, determining an individual score for the image for each characteristic in the second set, combining the individual scores to determine an overall score for the image, and ranking the image to determine what it warrant the bonus classification.

17. A downloadable mobile app product with associated instructions and data for access by a mobile device of a user, that, when executed by a processor of the mobile device, causes the steps of the computer-implemented method of claim 13 to be performed.

18. A gaming machine adapted to iterate games involving wildlife which have one or more participating game players, comprising:

a plurality of motion-activated cameras arranged in various locations of a site area that is external to but in communication with the gaming machine, each motion-activated camera assigned a random number and triggered to capture an image upon an animal entering its view, a random number generator (RNG) which, prior to commencement of game play, is configured to generate and assign values to each of the motion-activated cameras in the site area to represent a plurality of numbered cameras, a game application module for allocating a respective numbered camera to each of the participating one or more game players for game play, a drawing module for calling a sequenced drawing of the numbered cameras upon a triggering event resultant from captured images of animals by the numbered cameras, a database for storing the assigned value corresponding to its numbered camera along with the image captured upon the triggering event, a classification module for analyzing stored images to determine which of the stored images pass a criteria for bonus classification, and a gaming module programmed to convey an award to one or more of the game players associated with a numbered camera whose captured image warrants a bonus classification.

19. The gaming machine of claim 18, wherein the order of calling the assigned values of the numbered cameras is chronological by timestamp of each camera's captured image.

20. The gaming machine of claim 19, wherein the game application, prior to commencement of game play, instructs to RNG as to specific parameters for the random generation and assignment of values to the motion-activated cameras.

* * * * *